US007770369B2

(12) United States Patent
Doyle et al.

(10) Patent No.: US 7,770,369 B2
(45) Date of Patent: Aug. 10, 2010

(54) APPARATUSES AND METHODS FOR APPLYING A STRAP AROUND A BUNDLE OF OBJECTS

(75) Inventors: David Richard Doyle, Aberdeen, WA (US); Knut O. Totland, Hoquiam, WA (US); Philip Floyd Jones, Hoquiam, WA (US); Donald Arthur Smith, Aberdeen, WA (US)

(73) Assignee: Enterprises International, Inc., Hoquiam, WA (US)

( * ) Notice: Subject to any disclaimer, the term of this patent is extended or adjusted under 35 U.S.C. 154(b) by 0 days.

(21) Appl. No.: 12/072,107

(22) Filed: Feb. 22, 2008

(65) Prior Publication Data

US 2008/0256900 A1 Oct. 23, 2008

Related U.S. Application Data

(60) Provisional application No. 60/903,230, filed on Feb. 23, 2007.

(51) Int. Cl.
*B65B 13/04* (2006.01)

(52) U.S. Cl. ..... 53/589; 53/399; 53/582; 100/2; 100/26

(58) Field of Classification Search ..... 53/399, 53/582, 589, 590; 100/2, 7, 26, 29, 32
See application file for complete search history.

(56) References Cited

U.S. PATENT DOCUMENTS 3,946,921 A 3/1976 Noguchi
4,885,901 A * 12/1989 Sakaki et al. ..... 53/589
5,236,329 A * 8/1993 Sylvester ..... 53/399
5,459,977 A * 10/1995 Haberstroh ..... 53/399
5,560,180 A 10/1996 Rodriguez et al.
6,076,338 A 6/2000 Maeda et al.
6,173,557 B1 1/2001 Kuei
6,363,689 B1 4/2002 Rodriguez et al.
6,655,117 B2 * 12/2003 Hoshino ..... 53/589
2002/0116900 A1 8/2002 Cranston, III et al.
2004/0200191 A1 10/2004 Armstrong et al.

FOREIGN PATENT DOCUMENTS

DE 298 22 344 U1 4/1999
DE 198 53 936 A1 9/1999
EP 0 485 097 A1 5/1992
EP 1 179 478 A2 2/2002

OTHER PUBLICATIONS

PCT Search Report and Written Opinion from PCT/US2008/054791.

* cited by examiner

*Primary Examiner*—Thanh K Truoung
(74) *Attorney, Agent, or Firm*—Seed Intellectual Property Law Group PLLC

(57) ABSTRACT

The present description discusses apparatuses and methods for applying straps around a bundle of objects by applying a variable force to tension the strap around the bundle of objects and then actuating a series of cams to control the sealing of the strap around the bundle of objects. The apparatus includes a track assembly extending substantially about a strapping station. The track assembly is adapted to receive a strap and to release the strap during a tensioning operation. An accumulator delivers strap to the track assembly. The accumulator has a strap conveyor system that defines a strap path and an accumulator container adjacent to the strap path. Strap can be accumulated in the accumulator container and subsequently delivered to the track assembly.

22 Claims, 29 Drawing Sheets

APPARATUSES AND METHODS FOR APPLYING A STRAP AROUND A BUNDLE OF OBJECTS

CROSS-REFERENCE TO RELATED APPLICATION

This application claims the benefit under 35 U.S.C. §119 (e) of U.S. Provisional Patent Application No. 60/903,230 filed Feb. 23, 2007, which is incorporated herein by reference in its entirety.

BACKGROUND

1. Technical Field

The present invention relates generally to apparatuses and methods for applying one or more straps around a bundle of objects. The apparatuses have an accumulator for accumulating the straps.

2. Description of the Related Art

Strapping machines for applying flexible straps around bundles of objects have been developed in recent years and are disclosed in U.S. Pat. No. 5,560,180; U.S. Pat. No. 6,363,689; and U.S. Patent Application Publication No. 2002/0116900 A1. A conveyor often conveys a bundle to a strapping station where straps are automatically applied before the conveyor moves the strapped bundle away from the strapping station.

FIG. 1 is a front isometric view of a conventional strapping machine 10. The strapping machine 10 has several major assemblies, including a feed and tension assembly 15, an accumulator 14, a sealing assembly 40, a track assembly 50, and a control system 60 having an operator interface region 65. The strapping machine 10 may also include a frame 70 that structurally supports and/or encloses the major subassemblies of the machine 10. The assembly and purposes of the conventional major assemblies are described in detail in U.S. Pat. No. 6,363,689. The accumulator 14 may accumulate a portion of the strap used for bundling. Unfortunately, accumulators are often prone to malfunctioning because of complicated moving parts used to feed the strap into receptacles of the accumulators. Additionally, it may be difficult to perform maintenance on the accumulator 14 because of limited access to the interior of the receptacle in which the strap is accumulated. Strap in the receptacle often becomes twisted, tangled, or otherwise distorted. Unfortunately, it is often difficult to access and manipulate the strap to return the strap to the desired configuration for further bundling.

SUMMARY OF THE INVENTION

The description presented below describes a strapping apparatus, assemblies of the strapping apparatus, and methods of applying one or more straps around a bundle of objects. The strapping apparatus described herein is comprised of separate assemblies. These assemblies can be modular and easily altered to fit various production and package specifications. A control system can augment the mechanical components of the strapping apparatus through automated operating and control signals and through the use of one or more drives (e.g., servomotor, stepper motors, and the like). For example, during a primary tensioning operation, the control system monitors one or more position signals from a feed pinch roller position sensor and terminates primary tensioning when a slippage condition is determined. The control system then initiates a secondary tensioning operation. The secondary tensioning operation lasts for a predetermined amount of time while the control system initiates a servomotor driven strap sealing operation that secures the strap around the bundle. The control system can also control the amount of strap accumulated in an accumulator before, during, and/or after the bundling process.

In some embodiments, a strapping apparatus for bundling objects includes a track assembly and an accumulator. The track assembly extends about a strapping station (e.g., a station in which objects are placed for strapping) and can be adapted to receive a strap and to bundle objects using the strap. The accumulator can be for accumulating the strap used by the track assembly. The track assembly can include various types of strapping stations suitable for use during the strapping process.

In some embodiments, the accumulator comprises a strap conveyor system and an accumulator container. The strap conveyor system includes a strap feeding unit and a strap receiving unit spaced apart from the strap feeding unit such that the strap path of travel extends between the strap feeding unit and the strap receiving unit. The accumulator container defines a chamber and an entrance. The accumulator container also includes a strap diverter movable between a closed position and an open position for closing and opening the entrance, respectively, such that the strap extends along the strap path of travel and is supported by or positioned over the strap diverter in the closed position and the strap is unconstrained and free to move downwardly through the entrance when the strap diverter is in the open position.

In some embodiments, a strapping apparatus includes a track assembly for bundling objects and an accumulator having a conveyor system and an accumulator receptacle. The strap conveyor system can feed strap into the accumulator receptacle using gravity.

In some embodiments, an accumulator for a strapping apparatus includes a first strap conveyor unit, a second strap conveyor unit, and an accumulator container. The accumulator container can define a chamber for receiving strap that is used by a strapping apparatus. The accumulator container includes a strap diverter movable between a strap support position and a strap accumulation position. The strap diverter includes an engagement region positioned alongside a processing line extending between the first strap conveyor unit and the second strap conveyor unit when the strap diverter is in the strap support position. In some embodiments, for example, the strap diverter can be positioned next to the processing line such that a strap positioned adjacent to the processing line can fall downwardly into the accumulator chamber. In some embodiments, a strap entrance for the chamber is formed between the first strap conveyor unit and the second strap conveyor unit as the engagement region moves away from the processing line when the strap diverter moves from the strap support position to the strap accumulation position.

In some embodiments, an accumulator for a strapping apparatus can include a strap conveyor system, a hinged strap diverter, and a strap receptacle. The strap conveyor system can have a window (e.g., a horizontally extending window) along which a strap can extend. The hinged strap diverter is spaced apart from the strap conveyor system. The strap diverter can be configured to engage a strap within the window of the strap conveyor system. The window can generally match the shape and configuration of an entrance of the receptacle.

The receptacle, in some embodiments, can have a chamber positioned below the strap conveyor system such that a section of the strap within the window is urged into the chamber due to gravity when the strap diverter is in the first position.

The strap diverter can be in a second position to prevent the strap from forming a loop in the chamber. In some embodiments, the section of strap can be tensioned. When the tension is reduced, the strap may sag down into the chamber via gravity.

In some embodiments, a method for conveying strap within an accumulator of a strapping apparatus includes moving a strap for a strapping apparatus generally along a processing line of the accumulator. The strap can be generally linear, curved, or in any other suitable configuration during this process. In some embodiments, the processing line is above a chamber of the accumulator container. A portion of the strap extending along the processing line can move away from the processing line, through an entrance of the accumulator, and into a chamber using, for example, gravity.

In some embodiments, the portion of the strap moves downwardly away from the processing line to fill the container. In some embodiments, the portion of the strap comprises moving a strap diverter from a strap supporting position to an accumulation position to create the entrance, which is beneath the portion of the strap. The entrance can be sized based on the size of the strap.

These and other benefits of the disclosed embodiments will become apparent to those skilled in the art based on the following detailed description.

BRIEF DESCRIPTION OF THE DRAWINGS

In the drawings, identical reference numbers identify similar elements or acts. The sizes and relative positions of elements in the drawings are not necessarily drawn to scale. The shapes of various elements and angles may not be drawn to scale, and some of these elements may be arbitrarily enlarged and positioned to improve drawing legibility.

DETAILED DESCRIPTION OF THE INVENTION

The present disclosure is directed to, among other things, strapping apparatuses, components and subassemblies of strapping apparatuses (e.g., an accumulator), and methods for strapping bundles of objects. Specific details of certain embodiments are set forth in the following description, and in FIGS. 2-29, to provide a thorough understanding of such embodiments. A person of ordinary skill in the art, however, will understand that the present invention may have additional embodiments and features, and that the invention may be practiced without several of the details described in the following description.

Throughout the following discussion and in the accompanying figures, the strap material is shown and referred to as a particular type of material, namely, a flat, two-sided, tape-shaped strip of material solely for the purpose of simplifying the description of various embodiments. It should be understood, however, that several of the methods and embodiments disclosed herein may be equally applicable to various types of strap material, and not just to the flat, two-sided, tape-shaped material shown in the figures. Thus, as used herein, the terms "strap" and "strap material" should be understood to include, without limitation, all types of materials used to bundle objects, for example, synthetic materials, natural materials, metallic materials, or some other more rigid strap material. One type of strap that may be used with all or some of the embodiments described herein is a paper cord-type strap comprised of individual round cords laterally bonded together to form a continuous strap. The strap may be rigid, semi-flexible, or flexible depending on the application.

Figure 1:
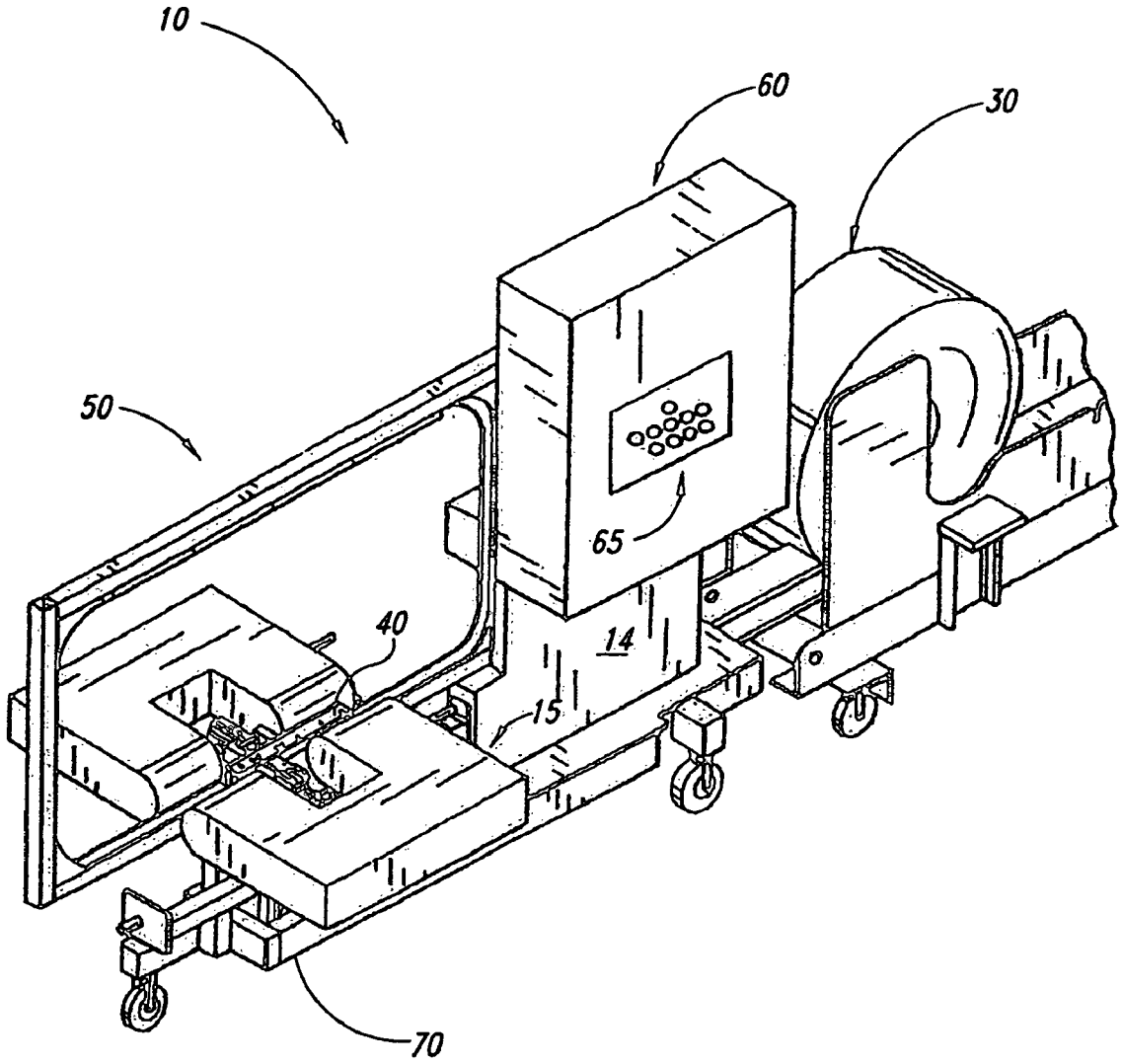
FIG. 1 (Prior Art)
FIG. 1 is an isometric and partial fragmentary view of a conventional strapping machine.
Figure 2:
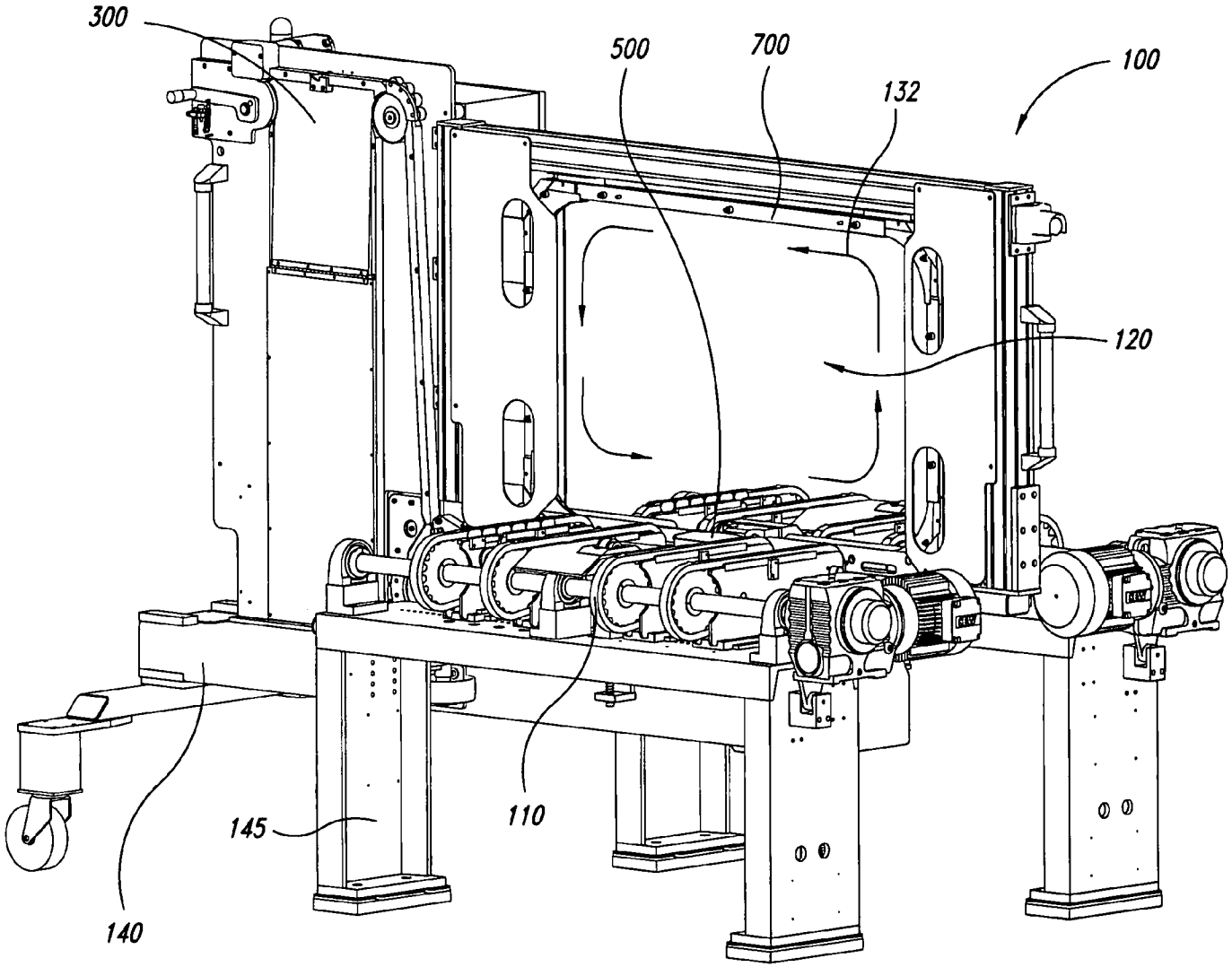
FIG. 2 is an isometric view of a strapping apparatus in accordance with one embodiment.

FIG. 2 illustrates a strapping apparatus 100 that includes a plurality of conveyors 110 for moving bundles in and out of a strapping station 120, which is surrounded by a track assembly 700. Strap employed during bundling operations is fed about the track assembly 700 in a strap-feed direction 132 that is in the counter-clockwise direction. A frame 140 for supporting the strapping apparatus 100 can be temporary or permanently affixed to the floor. The independently powered conveyors 110 are independently supported by conveyor frames 145.

Some of the other major assemblies of the strapping apparatus 100 include a control system for programming and controlling various functions of the apparatus, an accumulator 300, and a feed and tension unit for receiving and feeding the strap around one or more bundles on the conveyors 110. The strapping apparatus 100 can be further configured with a sealing head assembly 500 for sealing the strap around the bundle. At least some of the major assemblies can be of modular construction, which allows them to be used in multiple frame configurations or attached as add-on components to existing strapping machines. The illustrated accumulator 300 has a modular construction for use with a wide range of strapping machines. Various assemblies and components of the strapping apparatus 100 are discussed below.

Figure 3:
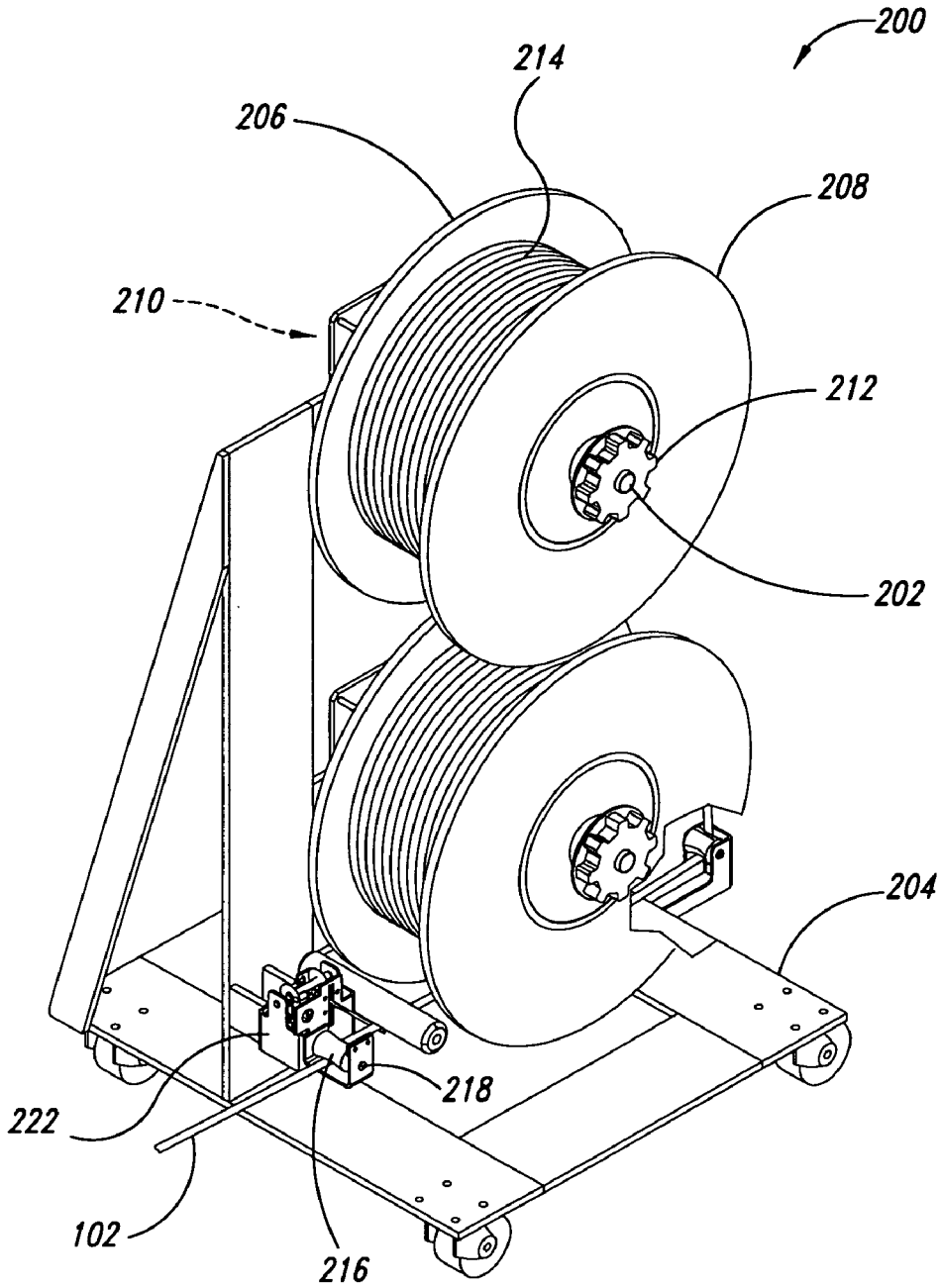
FIG. 3 is an isometric view of an embodiment of a strap dispenser for delivering strap to a strapping apparatus.

Strap Dispenser:

FIG. 3 illustrates one embodiment of a modular strap dispenser 200 that can be used with the strapping apparatus 100. The dispenser 200 includes a mounting shaft 202 extending outwardly from the frame 204 between an inner hub 206 and an outer hub 208. An electrically released spring brake 210, hidden behind the hub 206, is operatively coupled to the mounting shaft 202 and to the frame 204. When in a release mode, the brake 210 allows the rotation of the mounting shaft 202; whereas otherwise the brake 210 acts to restrict the rotation of the mounting shaft 202. A mounting nut 212 is rotatably mounted on the mounting shaft 202 and supports the inner hub 206 and the outer hub 208.

The dispenser 200 can include a guide pulley 216 held in place by a retainer 218. The guide pulley 216 permits a strap 102 to be smoothly routed from a strap coil 214 into the accumulator 300. The presence of the strap 102 as it is routed over the guide pulley 216 toggles a strap exhaust switch 222 as it enters an accumulator guide 318.

In addition, the dispenser 200 has more than one strap coil, thus allowing one coil 214 to act as a reserve coil while a second active coil 214 supplies the strapping apparatus 100. The active coil 214 in the illustrated embodiment is the bottom coil; however, one skilled in the art will recognize that the active coil could be either the upper or bottom coil.

Figure 4:
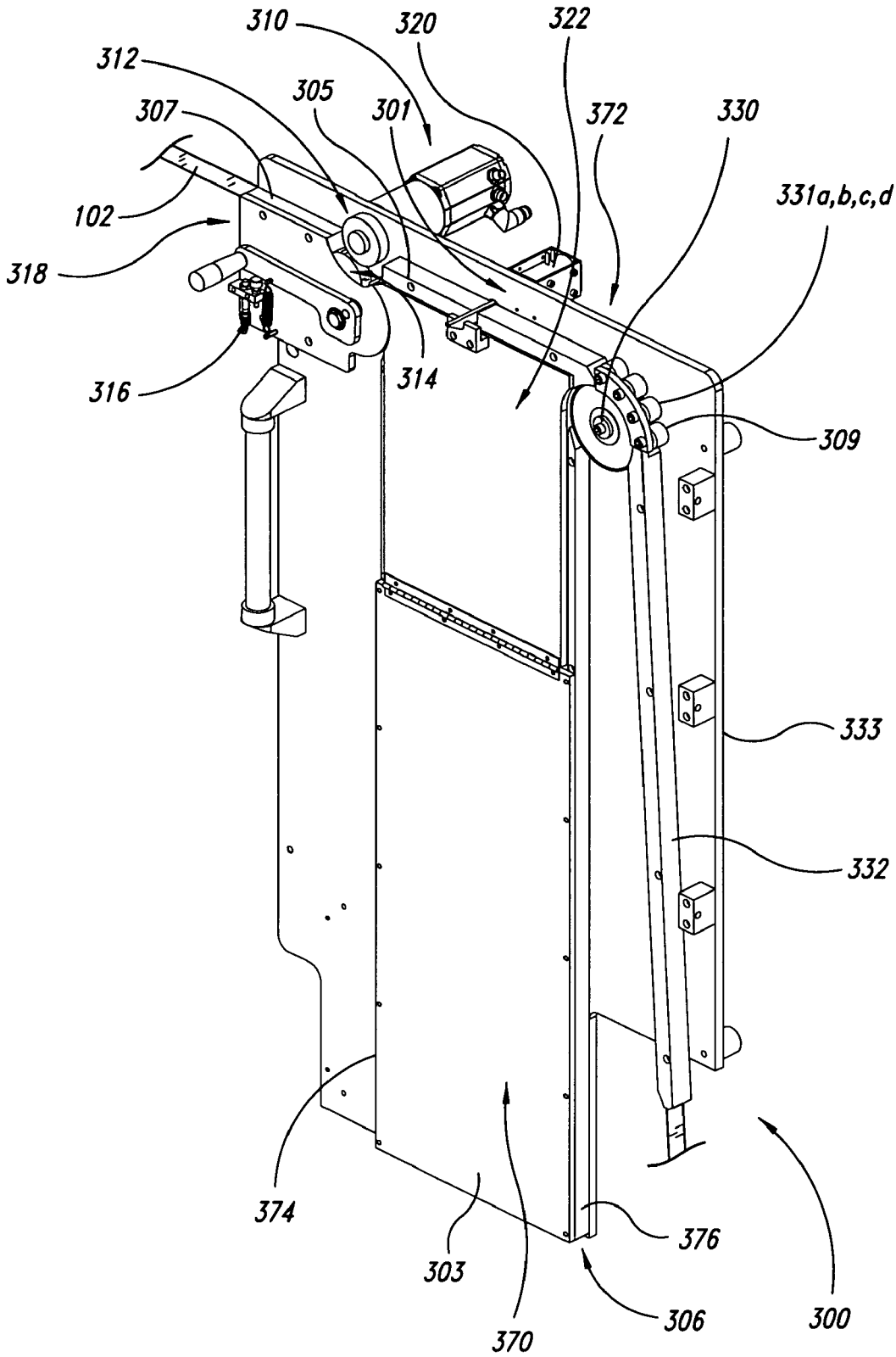
FIG. 4 is an isometric view of an accumulator in accordance with one embodiment.

Accumulator:

FIG. 4 illustrates one embodiment of the accumulator 300. The accumulator 300 includes a strap conveyor system 301 and an accumulator container 303. The strap conveyor system 301 can include a strap feeding unit 307 (integrated with the assembly guide 318 in FIG. 4) and a strap receiving unit 309 spaced apart from the strap feeding unit 307. The strap feeding unit 307 and the strap receiving unit 309 cooperate to deliver a desired amount of the strap 102, positioned below a horizontal guide 305, into the accumulator container 303. The accumulator container 303 is capable of protecting and storing the desired amount of strap for rapid feeding to the track assembly 700, as well as for temporarily storing the strap 102 that is retracted back during the tensioning process.

When the strap 102 is ready for feeding through the strapping apparatus 100 by the strap feeding unit 307, a strap diverter actuator 320 pulls a pivoting strap diverter 322 to a closed position. The strap 102 passes above the strap diverter 322 and is then routed through the strap receiving unit 309, which in turn conveys the strap 102 to a vertical guide 332, into a feed and tension unit (e.g., the feed and tension unit of FIG. 16), and eventually around the track assembly 700. The automatic feeding operation is used to fill the strapping apparatus 100 with strap 102. Various components, features, and methods of using the accumulator 300 are discussed in detail below.

The accumulator 300 of FIG. 4 includes an accumulator mounting body 333 for supporting various components and subassemblies, such as the units 307, 309. In some embodiments, the mounting body 333 can be in the form of a panel or sheet made, in whole or in part, of one or more metals (e.g., steel, aluminum, or combinations thereof), composite materials, polymers, plastics, and the like. The components and/or subassemblies can be permanently or temporarily coupled to the mounting body 333 via one or more welds, fasteners (e.g., nut and bolt assemblies, screws, etc.), rivets, or the like.

Figure 5:
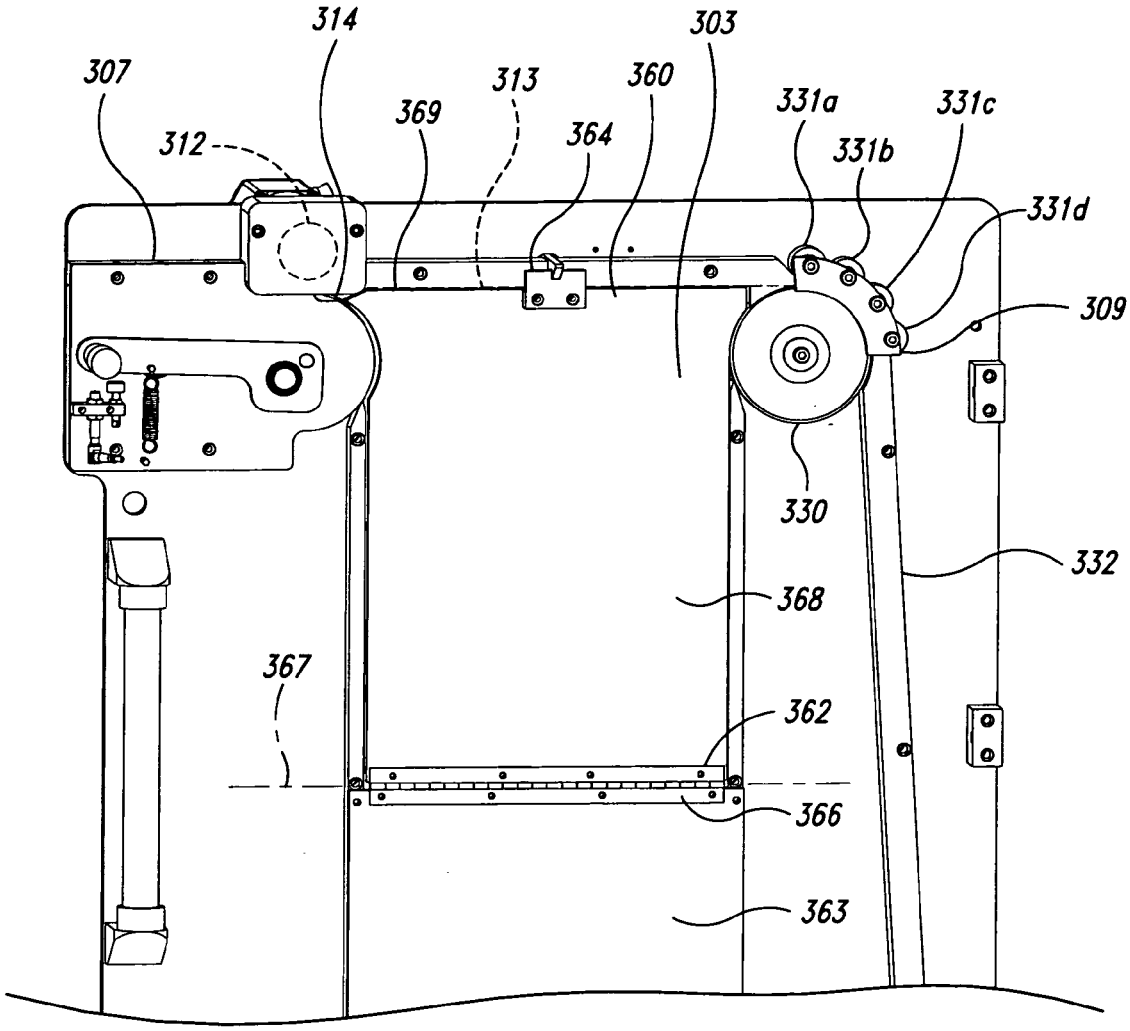
FIG. 5 is a front elevational view of a portion of an accumulator in accordance with one embodiment.

Referring to FIGS. 4 and 5, the strap feeding unit 307 includes a driver 310, a drive wheel 312 (shown in phantom in FIG. 5), and a pinch wheel 314. The driver 310 can be an electric motor capable of driving strap through the accumulator 300. As used herein, the term "driver" includes, but is not limited to, one or more motors or other devices capable of converting electrical energy into mechanical energy. Example motors include, without limitation, servomotors, induction motors, stepper motors, AC motors, and the like. The energized driver 310 can rotate the drive wheel 312 such that strap, between the drive wheel 312 and the pinch wheel 314, is moved at a desired speed (e.g., a generally constant speed or a variable speed) towards the strap receiving unit 309.

The strap can be transported along a processing line 313 (shown in broken line in FIG. 5) extending between the strap feeding unit 307 and the strap receiving unit 309. (The strap is not shown in FIGS. 5-11) The processing line 313 may thus define a strap path of travel between the units 307, 309. The processing line 313 may be generally linear, slightly curved, or may have any other suitable configuration for passing the strap across the top of the accumulator container 303. The illustrated processing line 313 is somewhat linear. One of ordinary skill in the art can select the appropriate length, orientation, and position of the processor line 313 relative to the accumulator container 303 to achieve the desired routing of the strap over the accumulator container 303, as discussed below.

The strap receiving unit 309 of FIGS. 4 and 5 includes a turn roller 330 and a plurality of guide rollers 331*a-d* (collectively 331), illustrated as antifriction idler rollers. The turn roller 330 and the plurality of guide rollers 331 are adapted to receive the strap and to guide the strap downwardly into the guide 332. In the illustrated embodiment of FIG. 5, the plurality of guide rollers 331 are adjacent to a portion of the turn roller 330 such that the strap is bent about the turn roller 330. The number and positions of the guide rollers 331 can be selected based on the size of the turn roller 330, orientation and position of the guide 332, and/or the maximum desired amount of bending of the strap, as well as other processing criteria known in the art.

Figure 6:
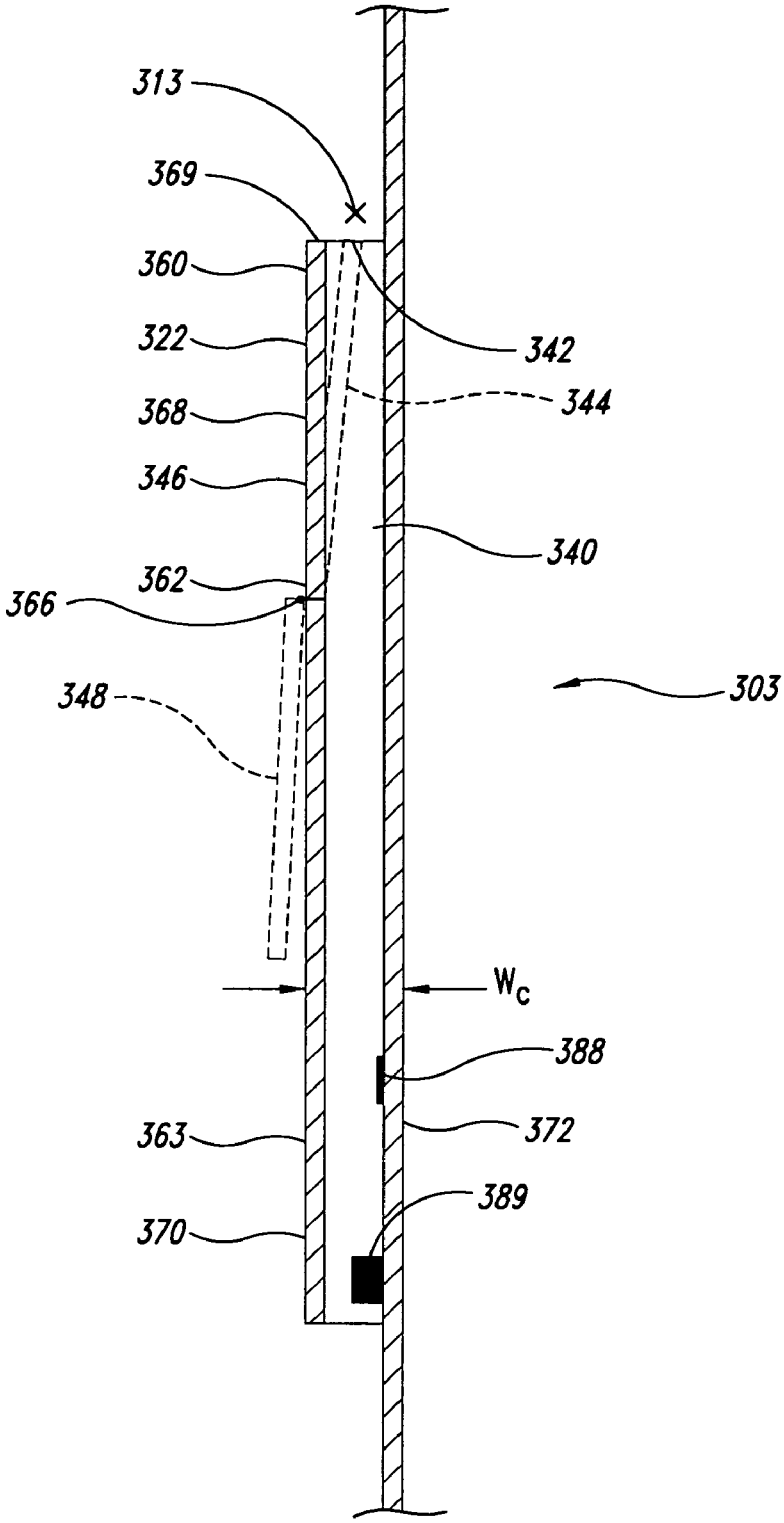
FIG. 6 is a cross-sectional view of an accumulator container in accordance with one embodiment. The features illustrated in FIG. 6 are not drawn to scale.
Figure 7:
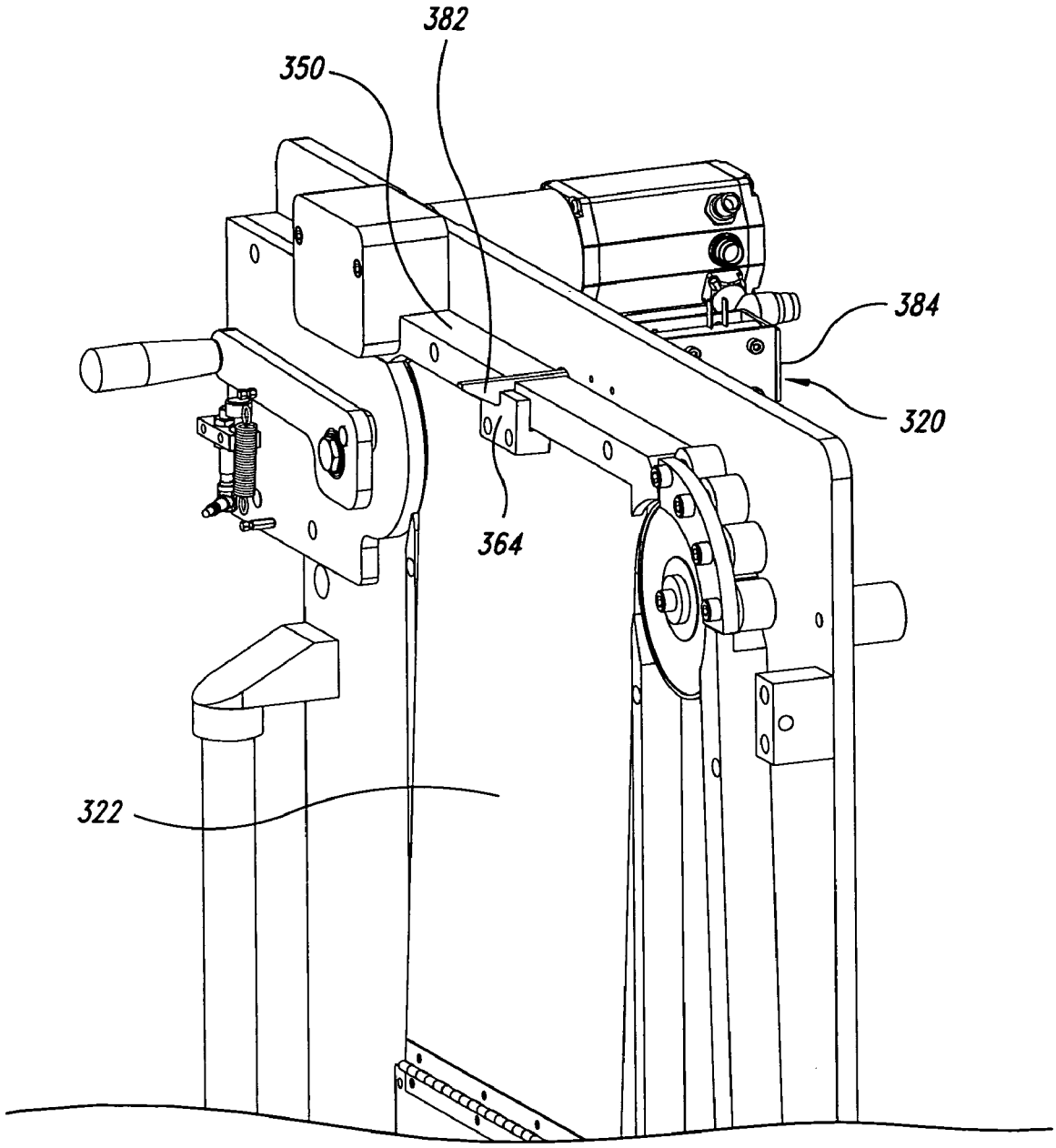
FIG. 7 is an isometric view of an upper portion of an accumulator in accordance with one embodiment.
Figure 8:
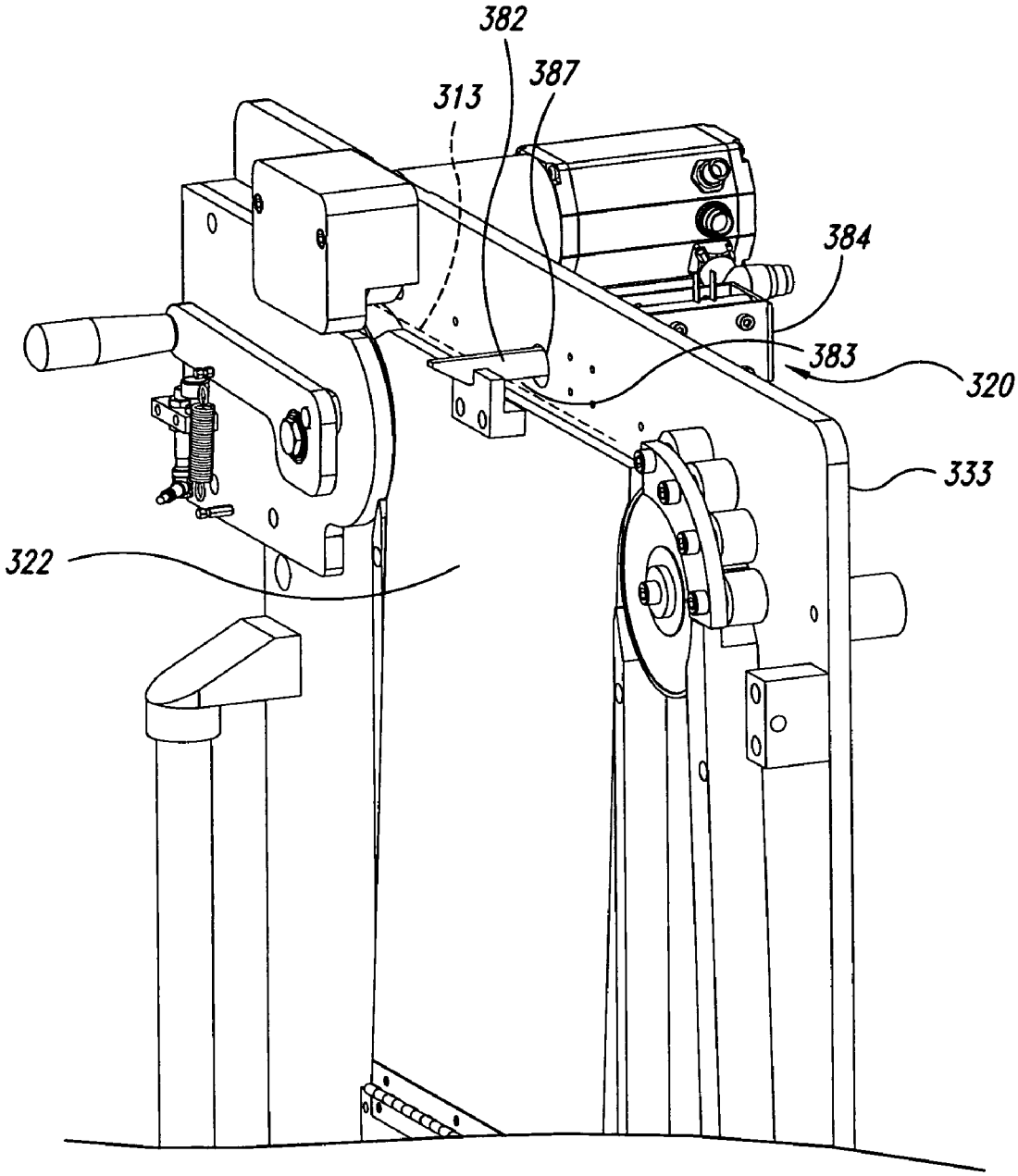
FIG. 8 is an isometric view of an upper portion of an accumulator having a horizontal guide shown removed, wherein a strap diverter is in a closed position, in accordance with one embodiment.
Figure 9:
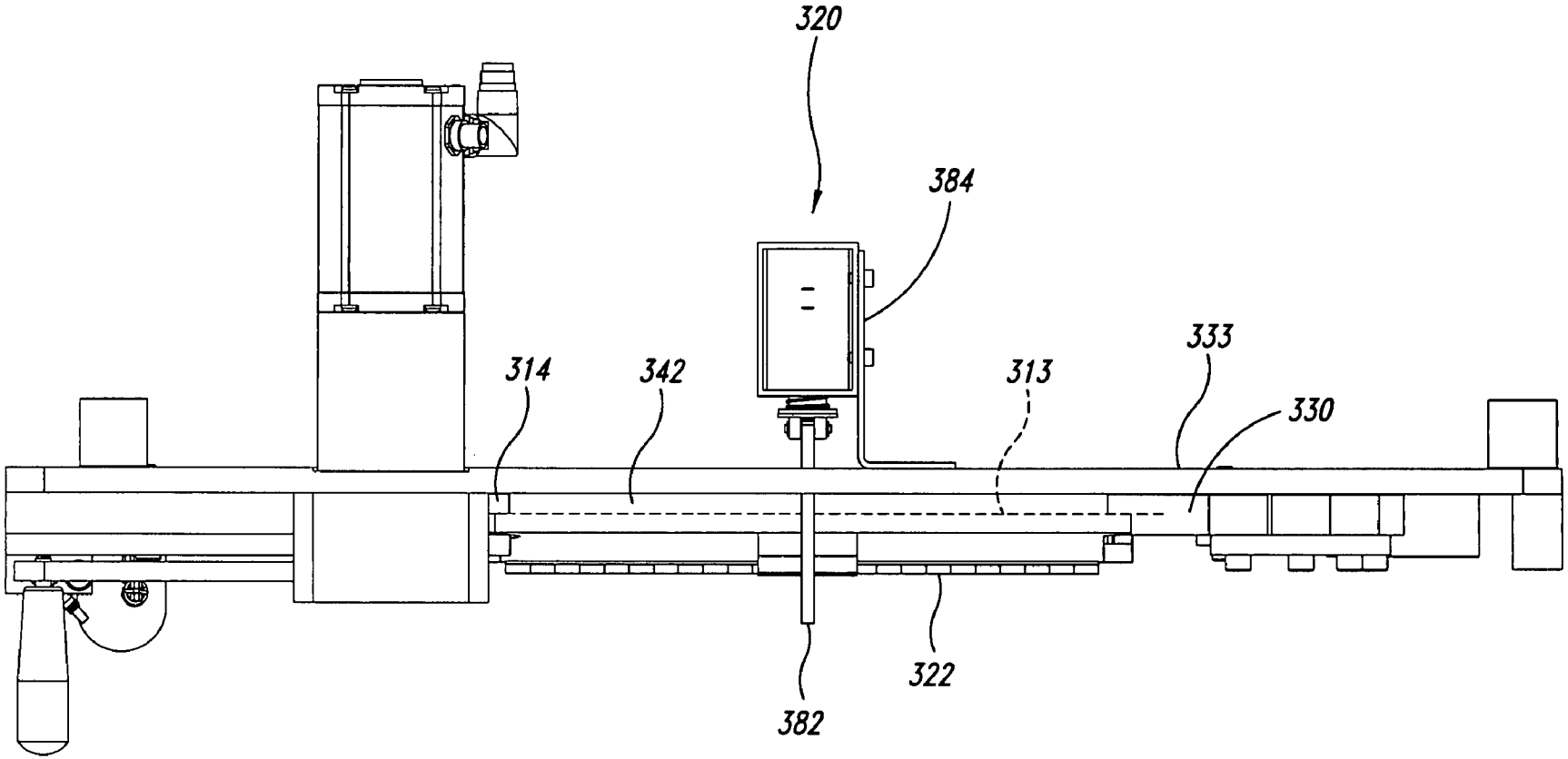
FIG. 9 is a top plan view of the accumulator of FIG. 8.
Figure 10:
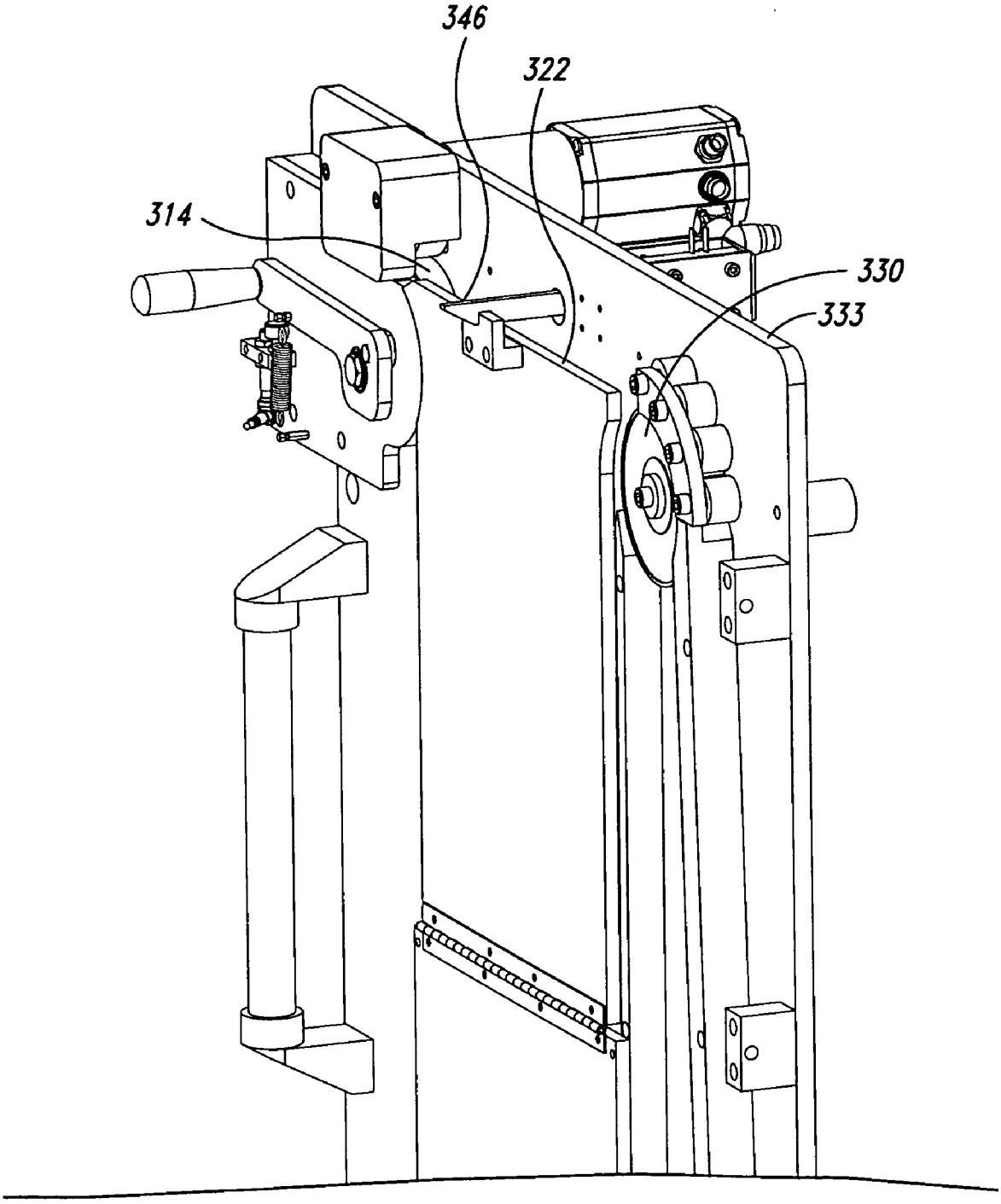
FIG. 10 is an isometric view of an upper portion of an accumulator having a horizontal guide shown removed, wherein a strap diverter is in an open position, in accordance with one embodiment.
Figure 11:
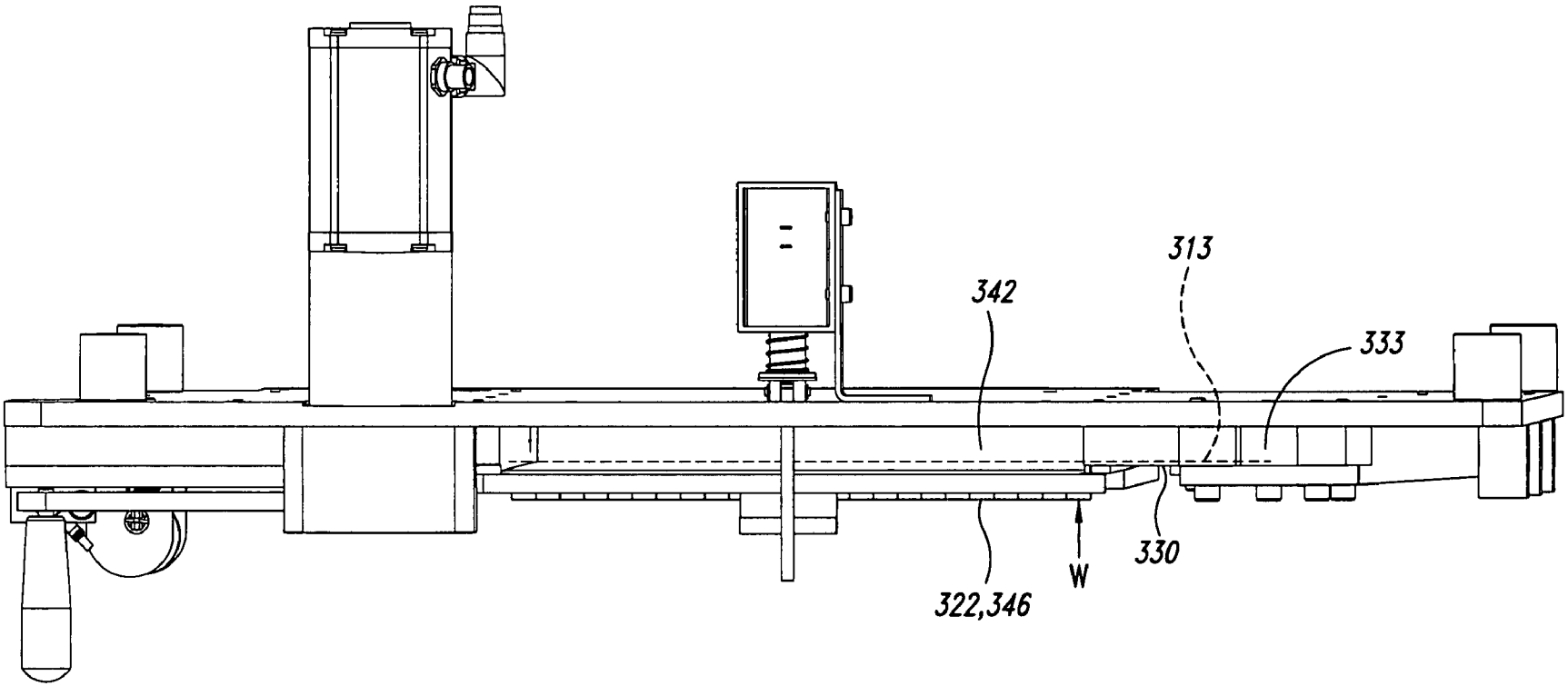
FIG. 11 is a top plan view of the accumulator of FIG. 10.

With reference to FIGS. 5 and 6, the accumulator container 303 is adjacent to the processing line 313 and defines a chamber 340 and an adjustable entrance 342. The accumulator container 303 includes the strap diverter 322 movable between a closed position 344 (represented by phantom lines in FIG. 6) for diverting strap from the chamber 340, an open position 346 for allowing the strap to enter the chamber 340, and an off-line position 348 (represented by phantom lines in FIG. 6) for accessing the chamber 340. FIGS. 7-9 show the strap diverter 322 in the closed position for guiding the strap. (The horizontal guide cover 305 of FIG. 7 is shown removed in FIGS. 8 and 9.) FIGS. 10 and 11 show the strap diverter 322 in the open position for allowing accumulation of the strap.

The size of the entrance 342 of FIG. 6 can be decreased by moving the strap diverter 322 from the open position 346 to the closed position 344. The size of the entrance 342 can then be increased by moving the strap diverter 322 from the closed position 344 to the open position 346. The strap diverter 322 can thus be in the open and closed position to open and close the entrance 342, respectively. The dimensions of the entrance 342 can be selected based on the dimensions of the strap thereby allowing the use of a wide range of straps, including thin and wide straps.

In some embodiments, including the illustrated embodiment of FIG. 9, the entrance 342 is defined by the pinch wheel 314, the turn roller 330 opposing the pinch wheel 314, the strap diverter 322, and the mounting body 333 opposing the strap diverter 322. The illustrated entrance 342 is an opening having a generally rectangular shape, as viewed from above. Other shapes and configurations are also possible, if needed or desired. When the strap diverter 322 is in the closed position, the closed entrance 346 has a relatively small width. The width of the entrance 346 can be increased by moving the strap diverter 322 to the open position. When the strap diverter 322 is in the open position (illustrated in FIG. 11), the entrance width W can be generally greater than the width of the strap. Accordingly, strap extending generally along the processing line 313 may be unconstrained and free to move downwardly through the entrance 342 into the chamber 340 when the strap diverter 322 is in the open position.

Referring again to FIGS. 5 and 6, the strap diverter 322 includes an engagement portion 360 for physically blocking the strap from the chamber 340, a lower mounting region 362 pivotally coupled to a stationary lower member 363 (illustrated as a panel), and a bracket 364. A coupler 366 in the form of a hinge couples the lower mounting region 362 to the lower member 363. The coupler 366 can be in the form of one or more hinges, flexible strips, articulatable couplers, and the like. The strap diverter 322 is rotatable at about an axis of rotation 367, illustrated in a generally horizontal orientation in FIG. 5, defined by the coupler 366. The axis of rotation 367 can be substantially parallel to the processing line 313 such that the engagement portion 360 is beneath the strap when the strap diverter 322 is in the closed position.

The engagement portion 360 includes an upper edge 369 that extends along substantially the entire length of the processing line 313, as shown in FIG. 5. As such, the engagement portion 360 can fill a window or space 371 between the units 307, 309. The upper edge 369 can be laterally spaced away from the processing line 313 a desired distance when the strap diverter 322 is in the open position. The upper edge 369 can be relatively smooth for reduced frictional interaction with the strap, thereby minimizing, limiting, or substantially eliminating unwanted damage to the strap. For example, the strap can slide along the smooth upper edge 369 without appreciable abrasion of the strap.

The strap diverter 322 of FIG. 5 has a panel 368 that includes the engagement portion 360 and the lower mounting region 362. The panel 368 can be generally flat to further reduce the profile of the accumulator 300. The panel 368 can be made, in whole or in part, of one or more optically transparent or semi-transparent materials to permit viewing of the contents, if any, of the accumulator container 303. Example optically transparent or semi-transparent materials include, without limitation, polyethylene terephthalate, acrylic (e.g., plexiglass), polystyrene, clear polyvinyl chloride (PVC), polycarbonate, screens, and combinations thereof, as well as other plastics and polymers that transmit light. In non-transparent embodiments, the panel 368 can be made, in whole or in part, of one or more metals, composite materials, plastics, combinations thereof, and the like.

The lower member 363 can be made of one or more optically transparent materials, semi-transparent materials, opaque materials, or combinations thereof. Thus, the lower member 363 can also permit viewing of the contents, if any, of the accumulator container 303. In non-transparent embodiments, the lower member 363 can be made, in whole or in part, of one or more opaque materials, such as metals, composite materials, wood, combinations thereof, and the like.

The hinged strap diverter 322 may function as an access door for accumulator cleanout and a guard for the processing line 313. A user can decouple the strap diverter actuator 320 and the bracket 364, manually move the strap diverter 322 to the off-line access position 348 of FIG. 6 to form a user access opening, and access the chamber 340 via the access opening to perform various operations (e.g., accumulator cleanout, sensor adjustment, machine inspection, and the like). For example, if the strap in the accumulator container 303 becomes tangled, the strap diverter 322 provides access to the chamber 340 so that a user can detangle the strap. The strap diverter 322 can be easily returned to the open or closed position to restart operation of the strapping apparatus 100.

With reference to FIGS. 4 and 6, the accumulator container 303 includes first and second sidewalls 370, 372 that substantially enclose the chamber 340. The first sidewall 370 includes the strap diverter 322 and the lower member 363, illustrated as a panel. The second sidewall 372 is spaced apart from the first sidewall 370 and is defined by a portion of the mounting body 333. In some embodiments, including the illustrated embodiment of FIG. 6, the first and second sidewalls 370, 372 are generally parallel to one another and define a chamber width $W_c$ that is at least slightly greater than the width of the strap. As shown in FIGS. 4 and 5, the accumulator container 303 can further include a pair of vertically extending end members 374, 376. The first and second sidewalls 370, 372 extend between the members 374, 376. In other embodiments, the container 303 can have a unitary construction. For example, the container can be a monolithically formed receptacle or other structure suitable for accommodating a desired amount of strap.

Referring to FIGS. 7-9, the strap diverter actuator 320 is operable to move the strap diverter 322. The strap diverter actuator 320 can include an elongate member 382 removably coupleable to the bracket 364 and a driver 384 capable of moving elongate member 382. For example, the elongate member 382 can be linearly moved along a line of action between a retracted position (FIG. 9) and an extended position (FIG. 11). The elongate member 382 is above the processing line 313 such that strap can pass through a gap 383 (FIG. 8) between the elongate member 382 and the strap diverter 322.

The illustrated driver 384 of FIG. 8 is fixedly coupled to the mounting body 333 such that the elongate member 382 extends through an aperture 387 in the mounting body 333. One or more fasteners, welds, rivets, combinations thereof, and the like can permanently or temporarily couple the strap diverter actuator 320 to the mount body 333, or other suitable component of the accumulator 300. The driver 384 can include one or more solenoids, pneumatic actuators, hydraulic actuators, combinations thereof, and the like. In some embodiments, for example, the driver 384 is a solenoid that linearly reciprocates the elongate member 382.

In use, the strap diverter actuator 320 can have a first configuration (shown extended in FIGS. 7-9) to position the strap diverter 322 in the open position and a second configuration (shown retracted in FIGS. 10 and 11) to position the strap diverter 322 in the closed position. The strap diverter actuator 320 can be energized to move the strap diverter 322 any number of times between the open and closed positions.

One or more sensors can be positioned along or near the accumulator 300 to detect a measurable parameter (e.g., line speed, amount of strap inside the accumulator container 303, position of the strap, and the like) and to send at least one signal indicative of the measurable parameter. For example, a sensor can determine whether an appropriate amount of the strap is disposed within the accumulator container 303. In some embodiments, including the illustrated embodiment of FIG. 6, sensors 388, 389 are positioned to determine whether a strap is within the chamber 340 and/or to determine the amount of the strap within the chamber 340. The sensors 388, 389 can be mechanical sensors (e.g., mechanical switches), optical sensors (e.g., photocell sensors), proximity sensors, lower limit photoeyes, or other types of suitable sensing devices. Any number of sensors can be positioned along the accumulator container 303. A control system (discussed below in connection with FIGS. 28 and 29) can use a timer for on-off to provide some hysteresis in the operation, if needed or desired. Additionally or alternatively, at least one sensor can be positioned proximate to the processing line 313 to detect at least one measurable parameter related to the strap, such as the line speed of the strap.

In operation, the strap 102 of FIG. 4 can be routed through the accumulator 300 and subsequently delivered to the track assembly 700 for strapping objects. The strap 102 is moved lengthwise along the processing line 313 such that at least a portion of the strap 102 is above the closed strap diverter 322. During this process, the strap 102 can be tensioned to keep the strap 102 generally straight. The strap diverter 322 may be used during the automatic feed mode, which precedes the normal automatic mode when the strapping apparatus is running in an automatic line. The accumulator 300 is used in the automatic feed sequence to feed the strap 102 into the track assembly 700. To accumulate strap, the strap diverter 322 can be moved to the open position to allow a section of the strap 102 to be passed through the entrance 342 and into the chamber 340 using, for example, gravity. Thus, the strap diverter 322 is closed while the strap 102 is moved across the top of the container 303 and is open while strap 102 is accumulated. The accumulation process is discussed below in connection with FIGS. 12-15.

Figure 12:
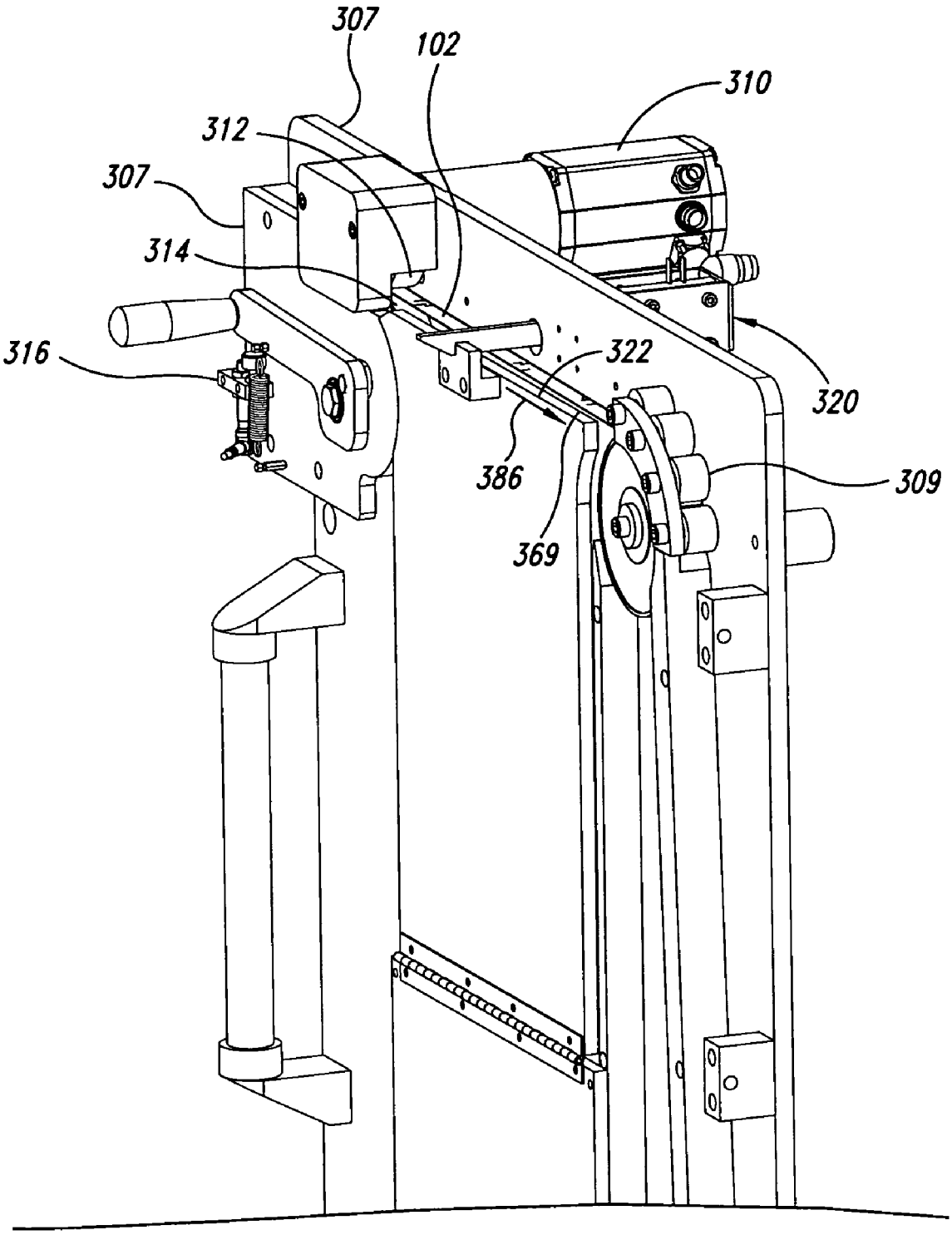
FIG. 12 is an isometric view of a strap moving along a strap conveyor system in accordance with one embodiment.

Referring to FIG. 12, the driver 310 (e.g., a servomotor operating in a torque mode rather than a positioning mode) drives the accumulator drive wheel 312 to feed the strap 102 between the drive wheel 312 (inside a housing) and the pinch wheel 314. An accumulator feed sensor 316 (e.g., a switch) of the feed strap unit 307 can be used to evaluate the operation of the accumulator 300.

The strap diverter actuator 320 positions the strap diverter 322 during the automatic feed sequence to feed the strap 102 into the downline components. The strap 102 can be moved lengthwise along the processing line 313 in the direction indicated by an arrow 386 of FIG. 12. The upper edge 369 of the strap diverter 322 can physically contact and support the strap 102. In some embodiments, the strap 102 is sufficiently tensioned to keep the strap 102 suspended above the upper edge 369, as shown in FIG. 12. If the tension is reduced, the upper edge 369 can prevent the sagging strap 102 from entering the accumulator container 303.

Figure 13:
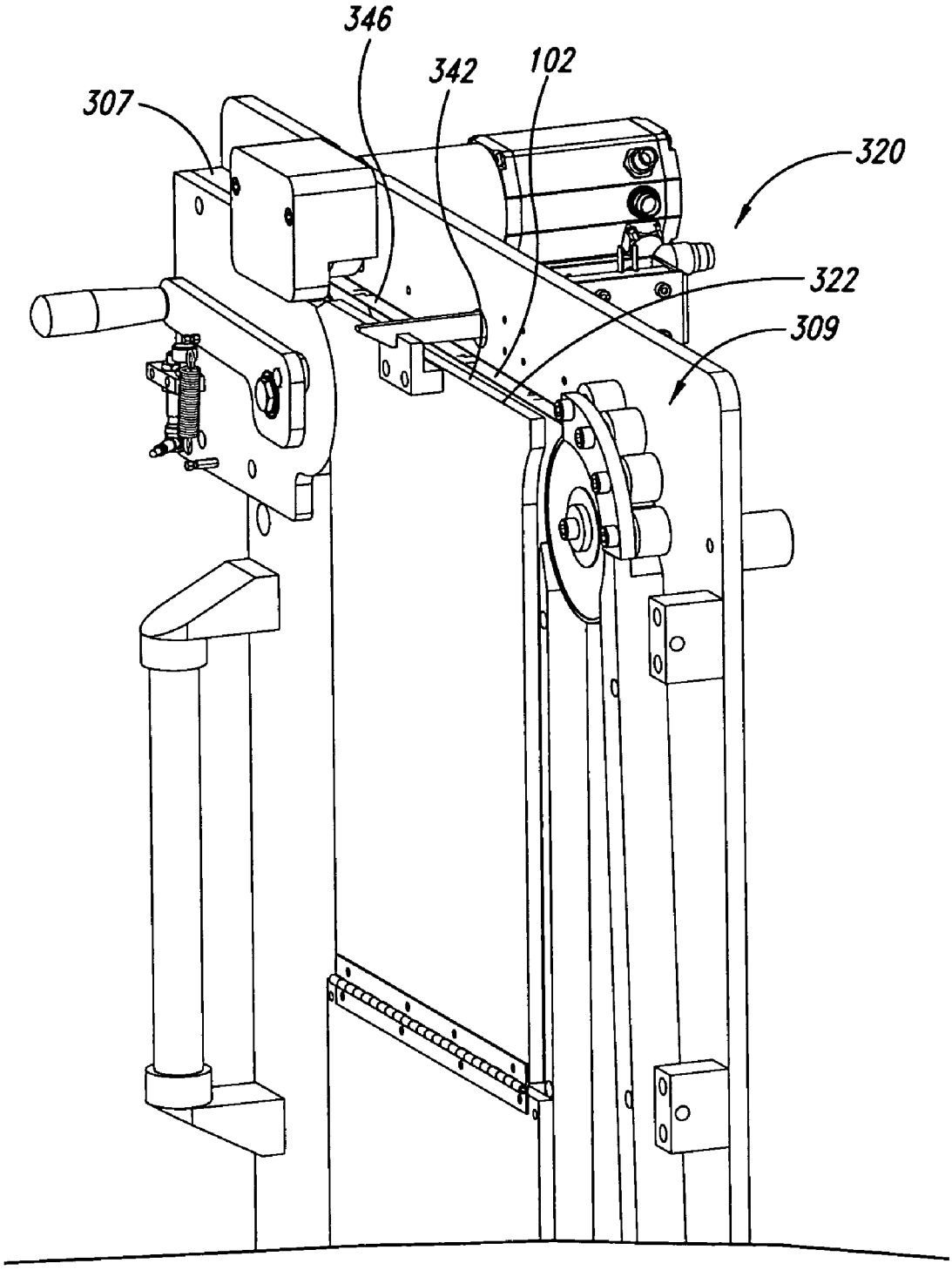
FIG. 13 is an isometric view of a strap ready to move into an accumulator container in accordance with one embodiment.
Figure 14:
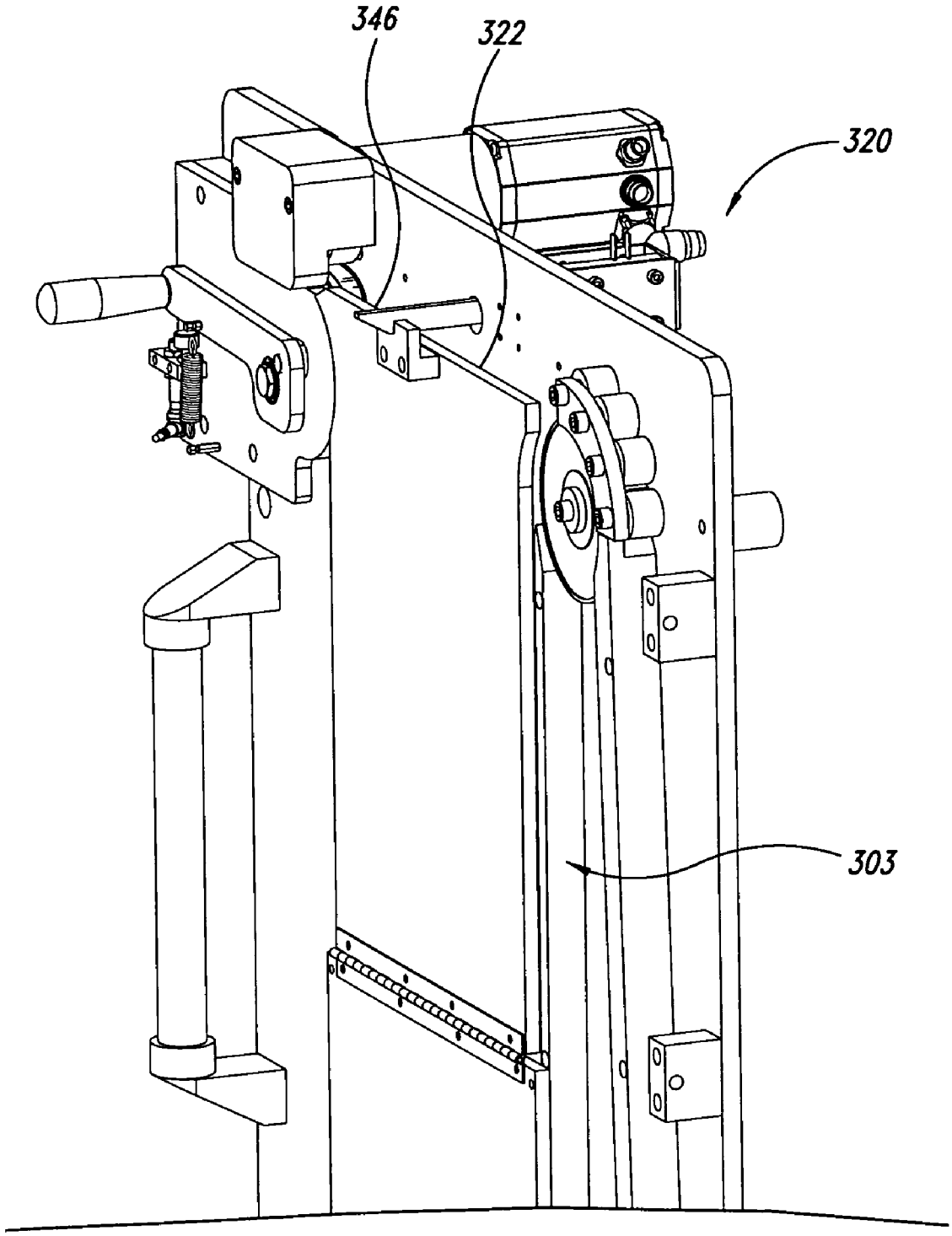
FIG. 14 is an isometric view of a strap extending downwardly into an accumulator container in accordance with one embodiment.

Once the strap 102 has been adequately established in the apparatus 100, the strap supply is maintained by the strap loop in the accumulator 300. To form a strap loop, the strap diverter actuator 320 moves the closed strap diverter 322 to the open position such that the upper edge 369 of the strap diverter 322 is laterally spaced away from the strap 102, as shown in FIG. 13. The strap feeding unit 307 and the strap receiving unit 309 are spaced apart from each other a sufficient distance to allow an unsupported section of a strap 102 to pass through the entrance 342. Gravity can draw the strap 102 downwardly through the entrance 342 and into the chamber 340. As shown in FIG. 14, for example, the unsupported strap 102 can curve downwardly towards the bottom of the accumulator container 303. Gravity can cause a reliable and consistent strap feeding action.

Figure 15:
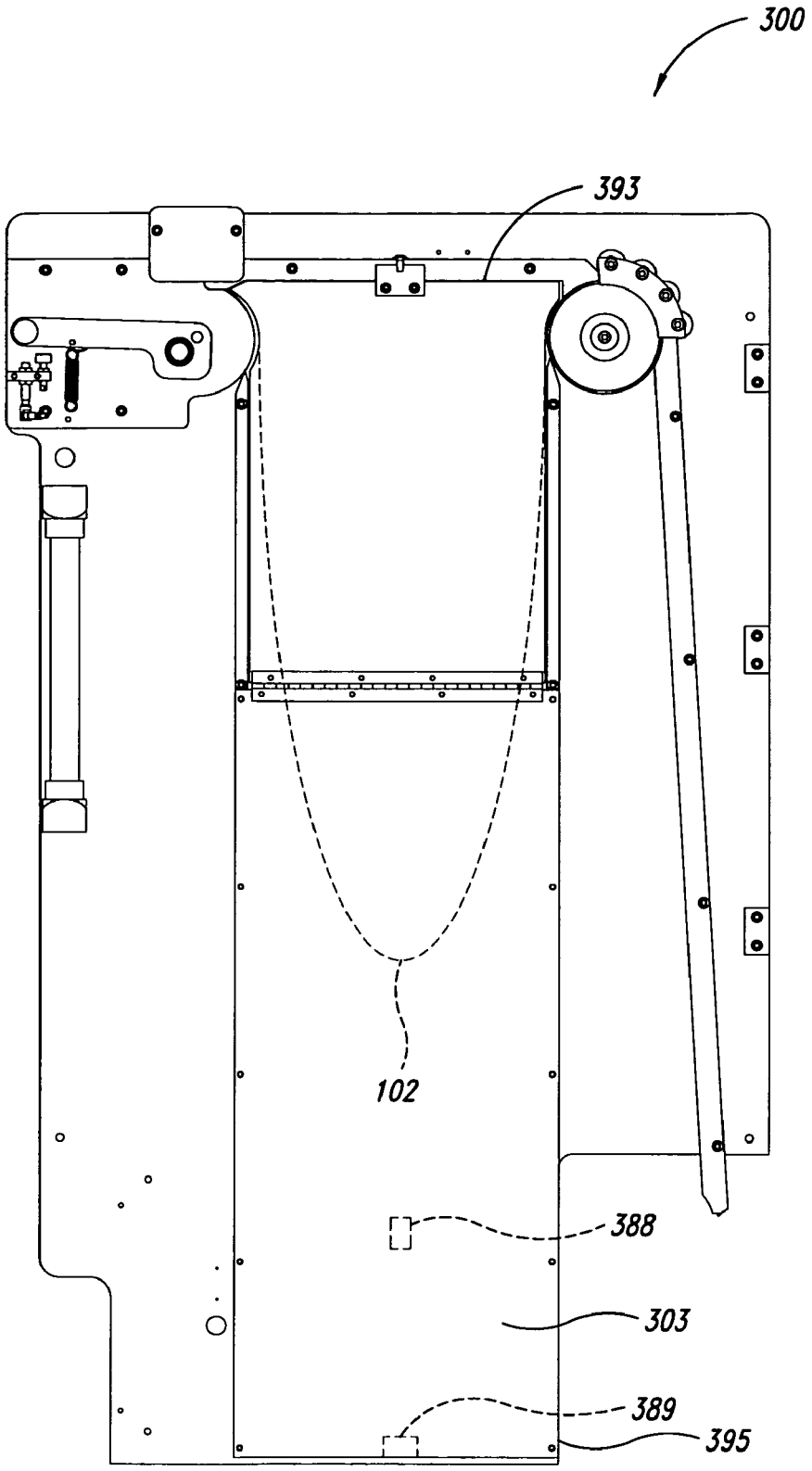
FIG. 15 is a front elevational view of an accumulator in which a strap extends downwardly into an accumulator container in accordance with one embodiment.

FIG. 15 shows the strap 102 (illustrated in phantom) after a loop is formed in the accumulator container 303. The loop extends downwardly from a top 393 of the accumulator container 303 towards the bottom 395 of the accumulator container 303. As such, the loop is positioned directly below the processing line 313 used during the feed sequence. The amount of strap in the accumulator 300 can be governed, at least in part, by using one or both sensors 388, 389 (shown in phantom). The sensors 388, 389 can be accumulator full sensors. The positions of the sensors 388, 389 can be selected based on the desired amount of strap to fill the accumulator container 303 or other processing parameters. For example, the sensor 389 can be located at or near the bottom 395 of the accumulator chamber 306, or any other suitable location. If the strap 102 contacts the sensor 389, the sensor 389 is actuated and sends one or more signals indicating that the desired loop has been formed. The accumulator 300 can fill with strap when this sensor 389 is de-actuated, thereby maintaining a desired amount of strap in the accumulator container 303.

Figure 16:
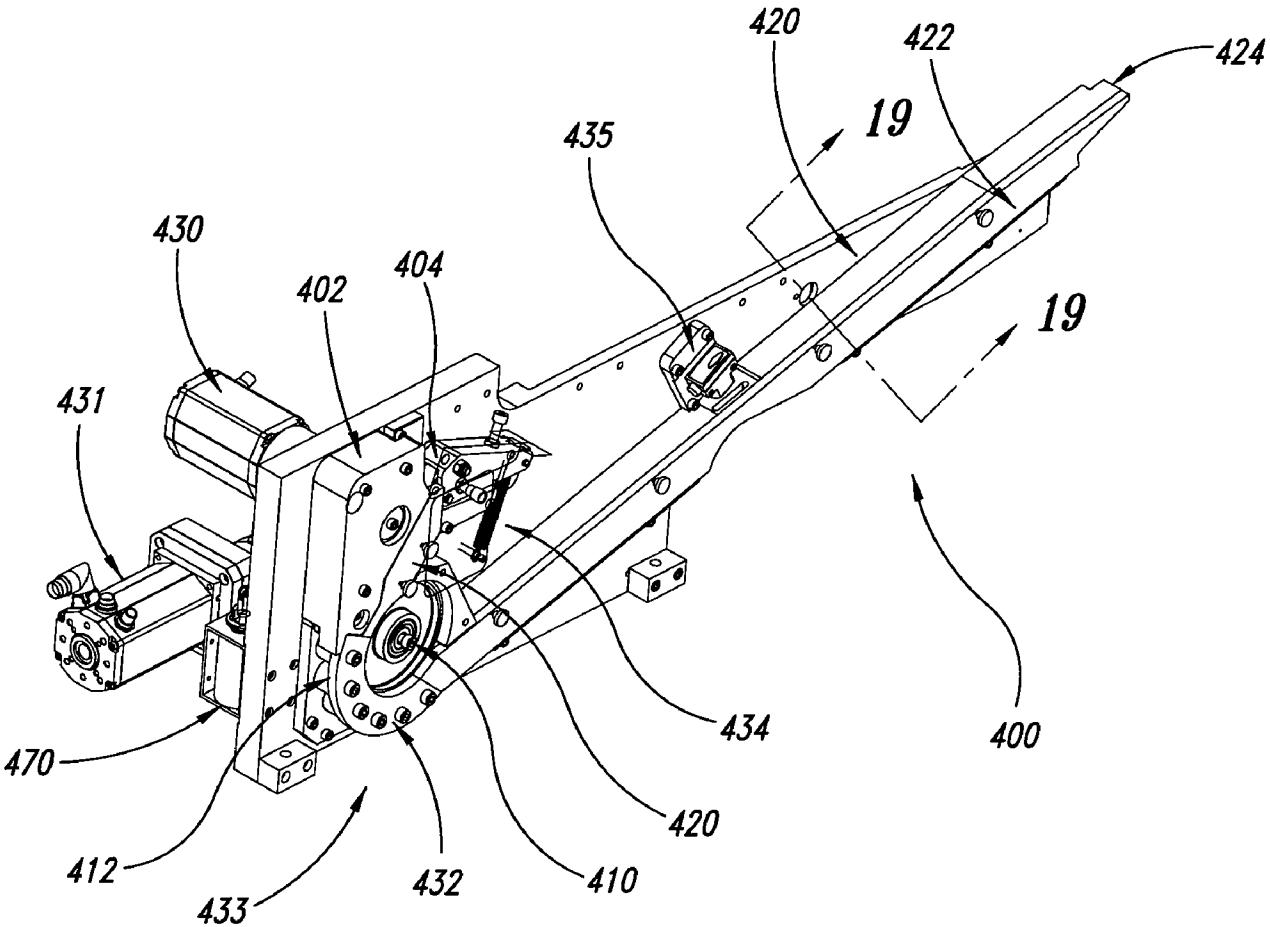
FIG. 16 is an isometric view of a feed and tension unit in accordance with one embodiment.
Figure 17:
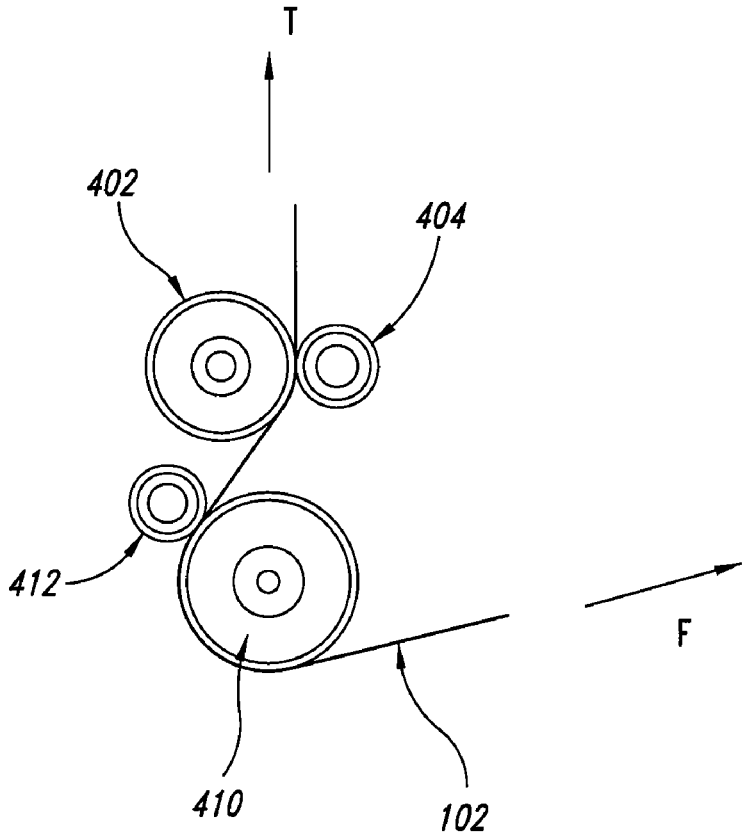
FIG. 17 is a partial front elevational view of the strap path through a portion of the feed and tension unit of FIG. 16.

Feed and Tension Unit:

FIG. 16 is an isometric view of the feed and tension unit 400. The feed and tension unit 400 is driven by a drive system. The drive system includes one or more motors (e.g., two or more servomotors 430 and 431). FIG. 17 depicts the path of the strap 102 as it moves through the various components of the feed and tension assembly 400. As best seen in FIG. 17, there are two sets of wheels in the feed and tension unit 400. A first set of wheels is comprised of a feed and primary tension drive wheel 402 and a feed and primary tension pinch wheel 404. The feed and primary tension wheels 402, 404 provide the strap feed during the feed cycle and the majority of strap take-up during the start of tension cycle and during the initial stages of a bundling operation. The feed and primary tension pinch wheel 404 is loaded against the feed and primary tension drive wheel 402 by an extension spring attached to the feed and primary tension pinch wheel pivot arm. A second set of wheels is comprised of a secondary tension drive wheel 410 and a secondary tension pinch wheel 412. As described in more detail below, the primary and secondary tensioning components provide a two-stage force operation for enhanced controllability of the strap 102 during bundling and sealing operations, such as allowing the strap 102 to be quickly accelerated around the bundle. The secondary tension drive wheel outer guide 432 is equipped with idler rollers 433 to provide an anti-friction surface for the strap during the feeding operation. To assist in the primary tension cycle, the secondary tension drive wheel 410 is equipped with a one-way clutch allowing the drive wheel to free wheel in the tensioning direction. The feed and tension unit 400 of FIG. 16 also includes a solenoid 470 for engaging and disengaging the secondary tension pinch wheel 412. After the primary tension sequence has drawn the strap around the product, the secondary tension servomotor 431 continues to draw the strap around the product until the servomotor 431 reaches a preset torque value signaling the control system 800 that the tension operation has been completed. This tension value is adjustable for various types of products.

Referring to FIG. 17, the feeding direction of the strap is indicated as "F" and the tensioning direction is indicated as "T." This configuration results in greater strap tension due to the increased contact area on the secondary tension drive wheel 410.

Referring back to FIG. 16, as the strap 102 passes through each of the above described pinch wheels, a plurality of inner guides 420 and a plurality of outer guides 422 keep the strap 102 in line as it is directed toward the track assembly 700. Also included in the inner guide 420 is a strap sensor 435 to detect the strap end for feeding, retracting, and/or re-feeding operations. The strap sensor 435 can be a photocell sensor, although other types of sensors can be used.

Figure 18:
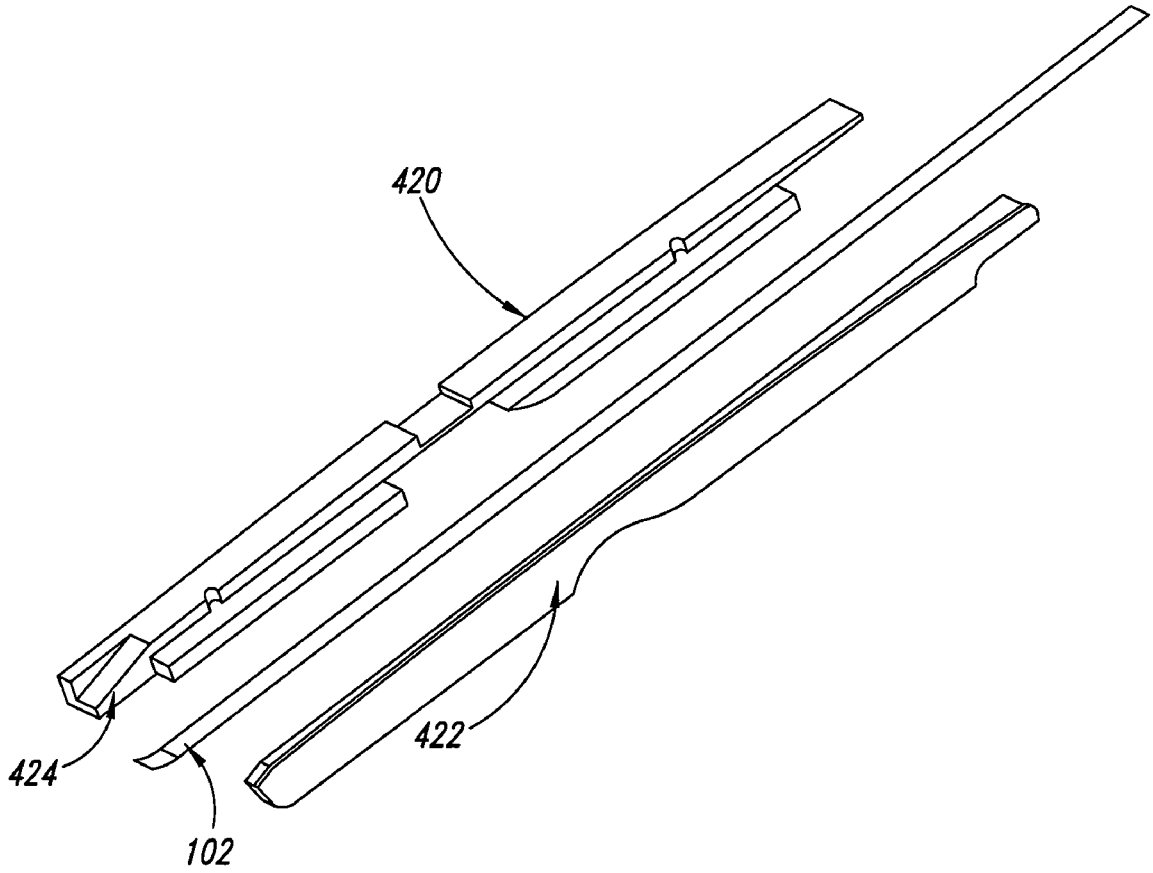
FIG. 18 is an enlarged partially-exploded isometric view of a pair of inner and outer strap guides of the feed and tension unit of FIG. 16.
Figure 19:
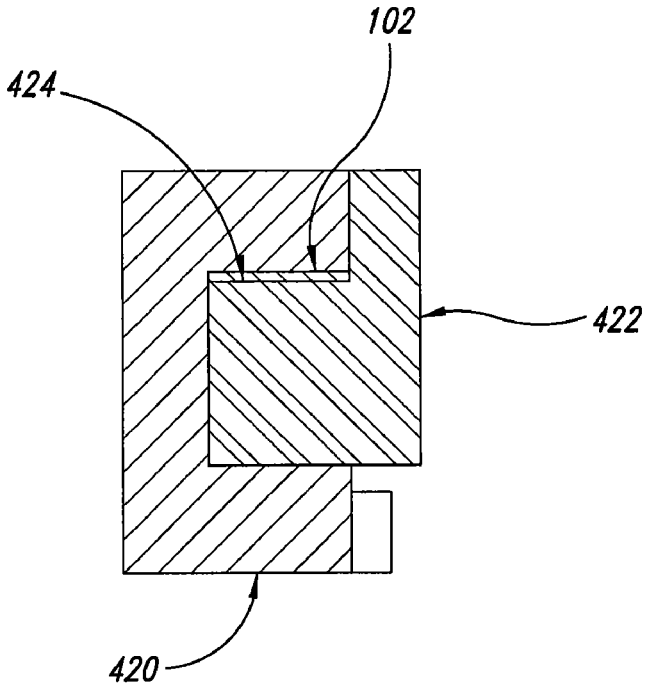
FIG. 19 is a cross-sectional view taken along line 19-19 from FIG. 16 of the "L-shaped" inner and outer guides of FIG. 18 that form a guide slot for the strap.

FIG. 18 is an enlarged partially-exploded isometric view of a pair of inner and outer strap guides 420, 422 of the feed and tension unit 400 of FIG. 16. As best viewed in FIG. 19, the "C-shaped" inner guide 420 has a roughly C-shaped cross-section and is coupled to a matching "L-shaped" outer guide 422 to form a strap channel 424 through which the strap 102 passes. The inner and outer guides 420 and 422 are secured in position FIG. 16 by a plurality of magnets 428, although a variety of other securing devices (e.g., cap screws, thumb screws, and the like) may be used.

Figure 20:
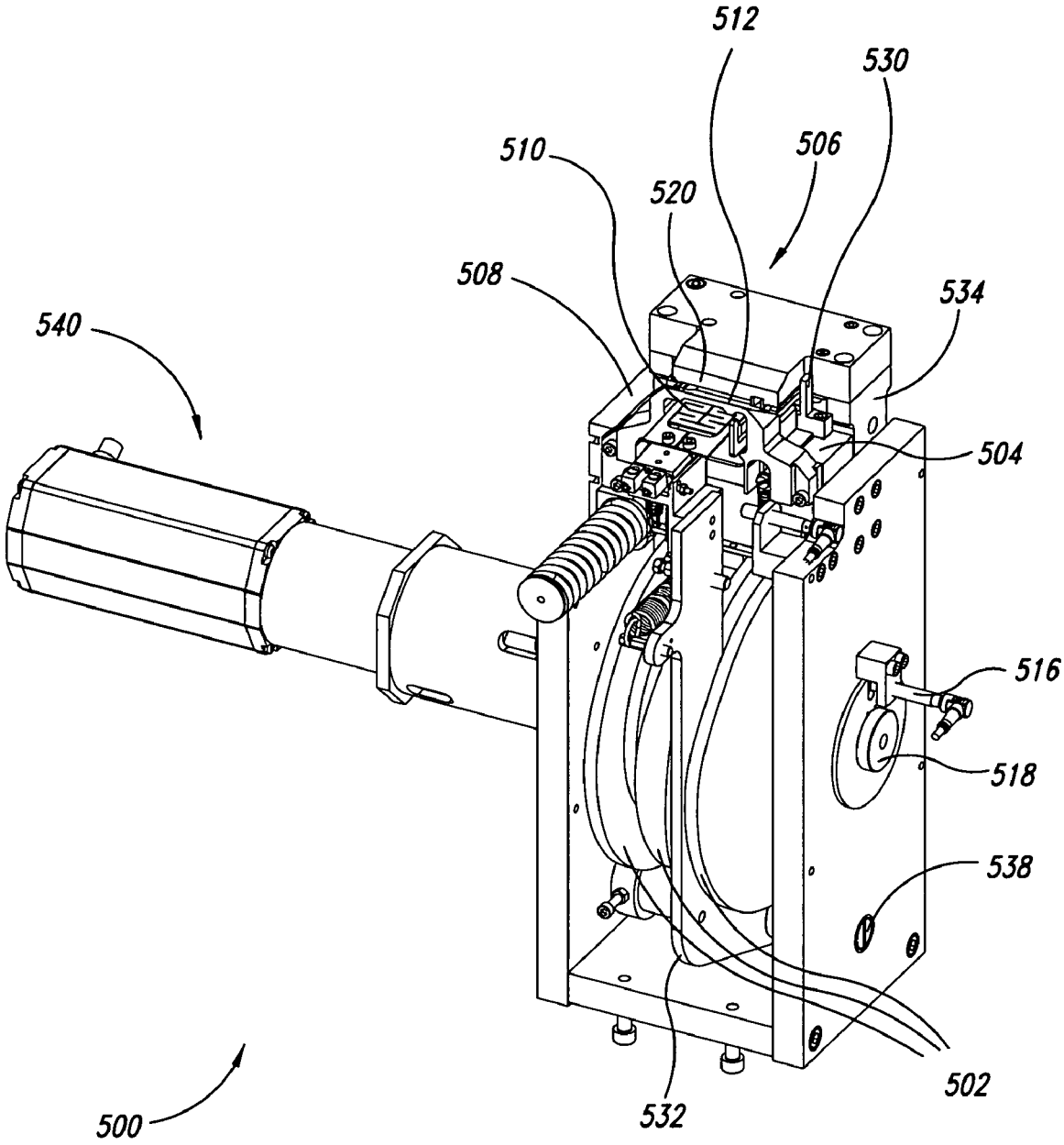
FIG. 20 is an isometric view of a sealing head assembly in accordance with one embodiment.
Figure 21:
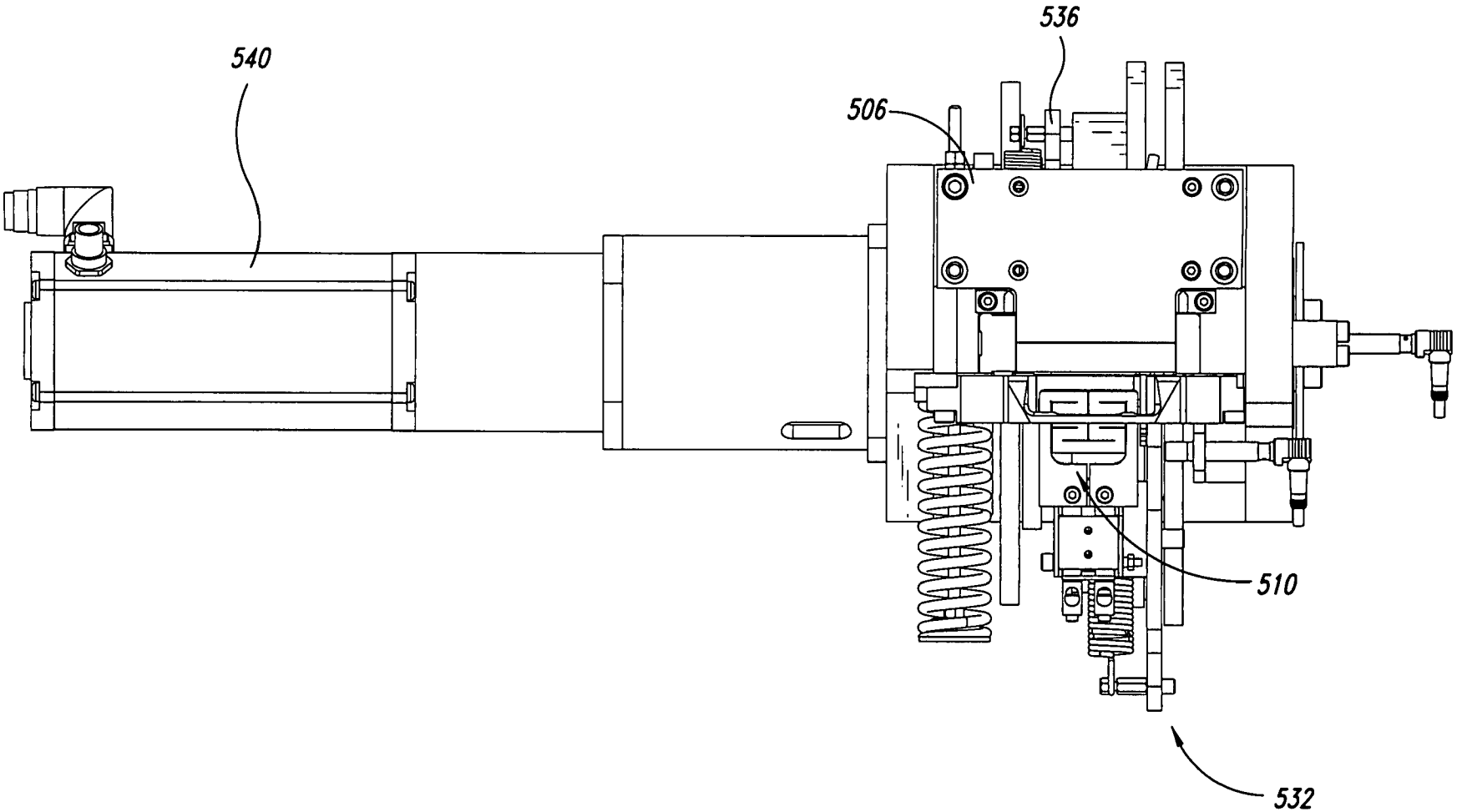
FIG. 21 is a top elevational view of the sealing head assembly of FIG. 20.
Figure 22:
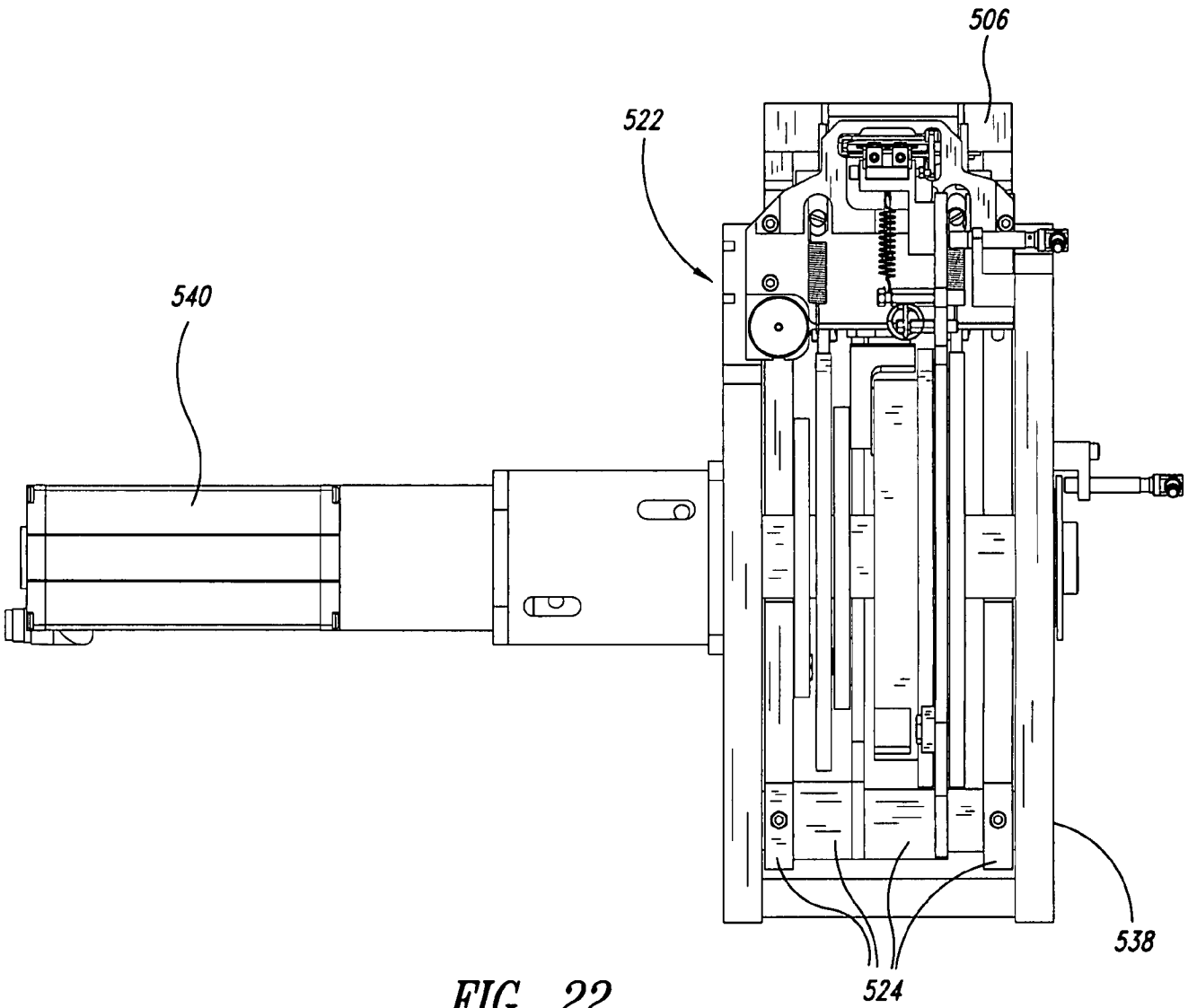
FIG. 22 is a back elevational view of the sealing head assembly of FIG. 20.

Sealing Head Assembly:

FIGS. 20 through 22 illustrate one embodiment of a sealing head assembly 500 for sealing the strap 102 during a bundling operation. FIG. 20 is an isometric view of the sealing head assembly 500 of the strapping apparatus 100 of FIG. 2. FIGS. 21 and 22 are top elevational and front elevational views, respectively, of the sealing head assembly 500 of FIG. 20. The sealing head assembly 500 is comprised of a servomotor 540 driven main shaft 518 and a series of cams 502 which mechanically sequence the gripping, sealing and cutting functions. These cams 502 drive three sliding members 522, three rotating arms, a heater arm 532, anvil follower arms 534, and an inner slide follower arm 536 (FIG. 21). A cam roller is connected to each rotating arm. The cams permit both linear and pivoting follower arrangements. The gripper 504, the cutter/gripper 508, and the platen 512 are linear followers meaning that their cam rollers operate directly over the sealing head cam centerline. The heater arm 532, the anvil follower arm 534, and the inner slide follower arm 536 pivot about an arm pivot shaft 538 proximately located and substantially parallel to the servomotor 540 driven main shaft 518. This configuration causes the rotating arms to pivot through an arc as the arm mounted cam rollers follow their respective cam profiles. The inner slide follower arm 536 is not solidly connected to the inner slide 520 as it is on the heater blade 510 and the anvil 506. This arrangement permits the inner slide 520 to slide linearly inside the anvil rather than pivoting through an arc. The inner slide follower arm 536 is connected to the inner slide 520 by a pin and slot arrangement converting the pivoting movement of the inner slide follower arm 536 to linear motion required for the inner slide 520.

One slide member 522 is coupled to the cutter/gripper 508, another slide member 522 is coupled to the left-hand gripper 504, and the third slide member 522 is coupled to the press platen 512. The sliding members 522 perform the gripping, sealing and cutting functions, while the pivoting arms 524 move the inner slide 520, the anvil 506, and the heater blade 510 into and out of a strap path as required during a bundling operation.

Figure 23:
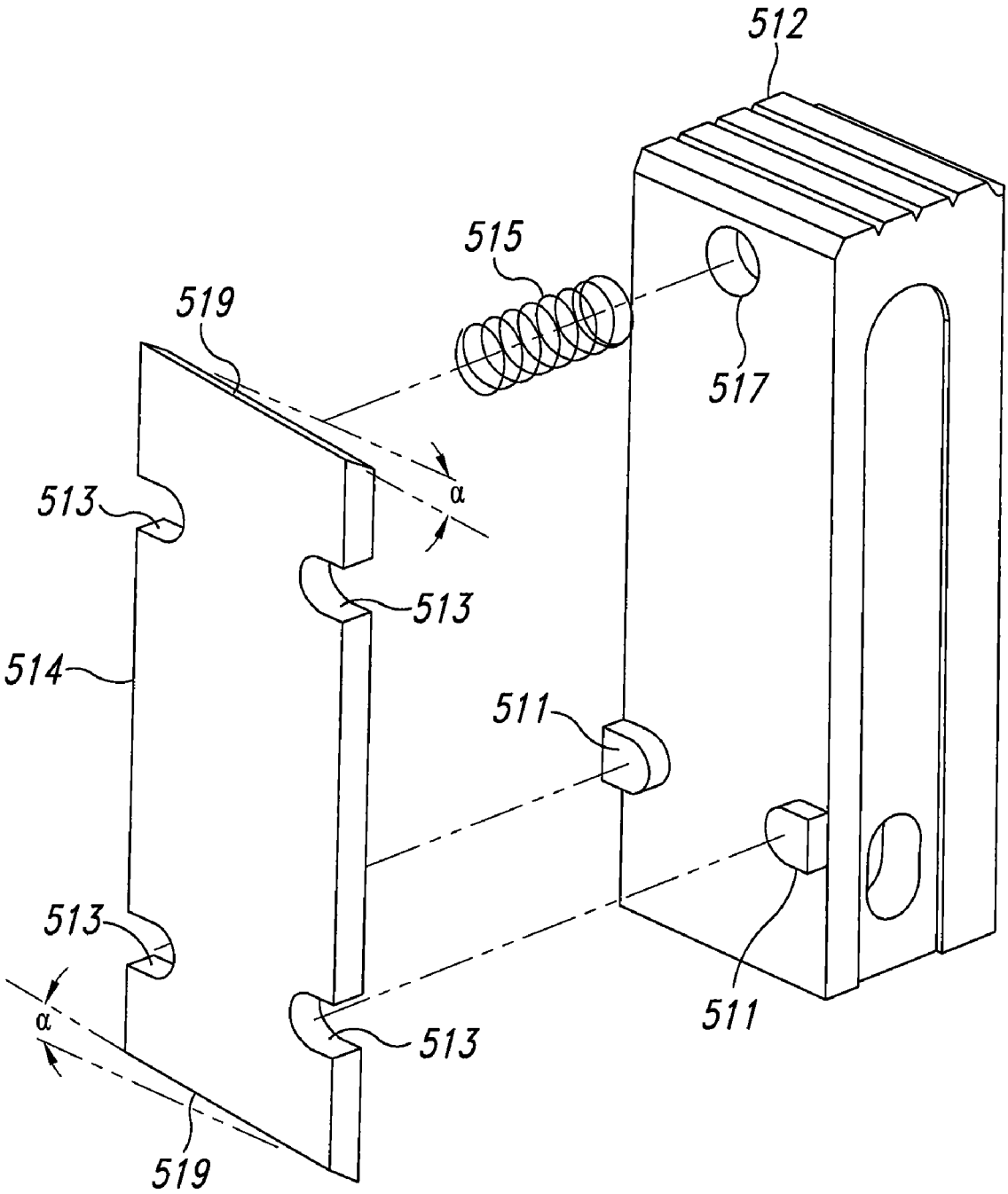
FIG. 23 is an isometric view of a press platen and a cutter prior to installation in the sealing head assembly of FIG. 20.
Figure 24:
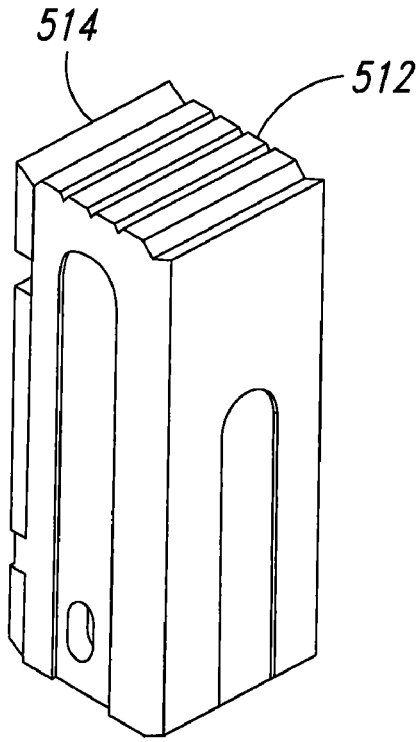
FIG. 24 is an enlarged isometric view of the press platen and cutter of FIG. 23 after assembly.

FIG. 23 is an exploded isometric view of the press platen 512 and cutter 514 of FIG. 24. As shown in FIG. 23, the press platen 512 includes a pair of mounting nubs 511, and the cutter 514 includes mounting recesses 513. A spring 515 is disposed between the cutter 514 and the press platen 512 with one end of the spring 515 being partially disposed within a seating hole 517 located in the press platen 512. The cutter 514 has cutting edges 519 at both ends, allowing the cutter 514 to be reversibly positioned on the press platen 512 for added operational life. In the embodiment shown in FIG. 23, the cutting edges 519 are slanted at an angle $\alpha$. Although a wide variety of cutting edge angles $\alpha$ may be used, a cutting edge angle in the range of approximately 5 to 15 degrees is desirable, while a cutting edge angle of about 9 degrees is preferred.

During assembly, the spring 515 is compressed between the cutter 514 and the press platen 512 until the two mounting recesses 513 slideably engage two of the mounting nubs 511. Recall that the cutter 514 has a pair of mounting recesses 513 situated near each end of the cutter 514; this allows the cutter 514 to be reversibly mounted onto the press platen 512. The cutter 514 and the press platen 512 are then positioned securely between the gripper and cutter/gripper 504 and 508 such that the pressure from these components maintains the compression of the spring 515. The cutter 514 and press platen 512 can then be engaged with the third slide member 522. This arrangement provides the necessary scissors action to sever the strap 102.

An advantage of the sealing head assembly 500 illustrated in FIGS. 20-22 is that the cutter 514 is removably and replaceably mounted to the press platen 512 by slideably engaging onto the press platen 512. This configuration allows the cutter 514 to be more easily removed for replacement or maintenance than in existing strapping machines. In addition, the dual blade and reversible positioning of the cutter 514 essentially doubles the use life of the cutter.

Figure 25:
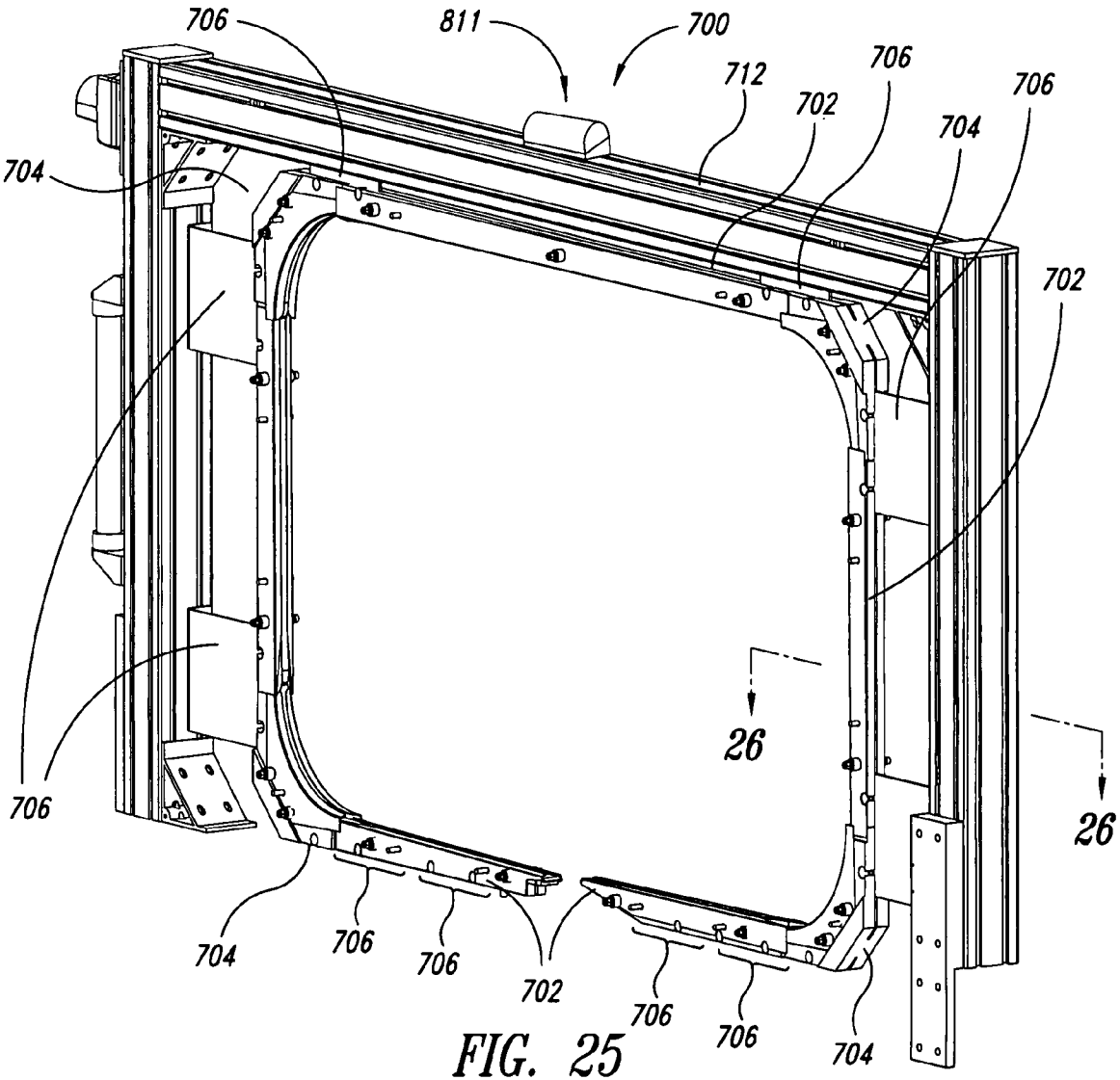
FIG. 25 is an isometric view of a track assembly in accordance with one embodiment.
Figure 26:
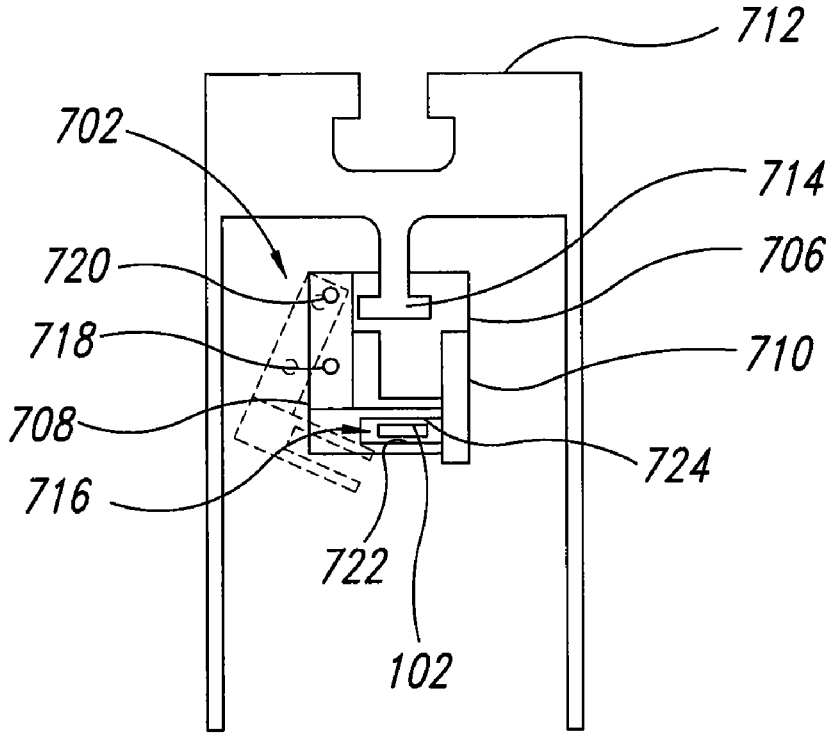
FIG. 26 is a partial sectional view of a straight section of the track assembly of FIG. 25 taken along line 26-26
Figure 27:
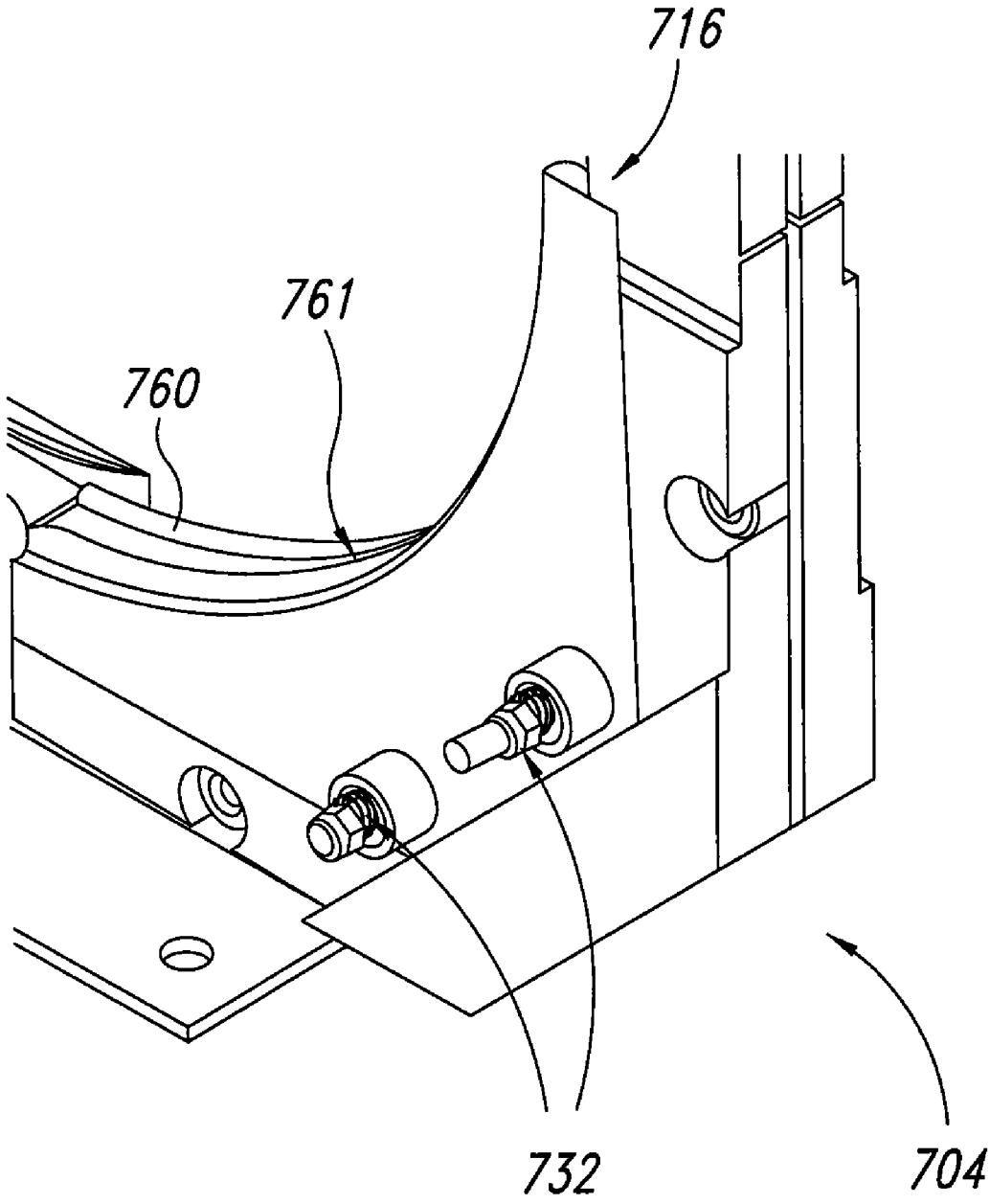
FIG. 27 is an isometric view of a corner section of a track assembly in accordance with one illustrated embodiment.

Track Assembly:

FIG. 25 is an isometric view of the track assembly 700 used to bundle objects. FIG. 26 is a partial sectional view of a straight section 702 of the track assembly 700 of FIG. 25 taken along line 26-26. FIG. 27 is an isometric view of a corner section 704 of another track assembly. In brief, the track assembly 700 directs the strap 102 around the strapping station 120 (FIG. 2). During a bundling operation, the strap 102 exits from the sealing head assembly 500 and is then guided completely around the track assembly 700, eventually doubling back on itself in the region of the sealing head assembly 500.

The track assembly 700 includes a plurality of straight track sections 702 and a plurality of corner track sections 704. As shown in FIGS. 25 and 26, each straight track section 702 includes a guide support 706 at each end of the straight section 702. Two straight track covers are affixed with compression springs 732 to each straight track section 702 to form a portion of a guide passage 716 that retains the strap 102 as the strap is guided through the track assembly 700. Referring to FIG. 26, the straight sections 702 and the corner track sections 704 are slotted to fit on the guide supports 706 mounted to the outer arch 712. The outer arch 712 forms a frame for the other components of the track assembly 700.

As shown in FIG. 27, each corner section 704 includes two track corner covers 761 affixed with compression springs 732 to each corner track section 704. The corner track section 704 and track corner covers 761 form a portion of the guide passage 716 therebetween. The compression spring 732 mounted to the track corner covers 761 pivotably open to release the strap 102 from the guide passage 716.

During the tensioning cycle, the strap 102 is drawn from the track assembly 700 by the tension unit 400. As the strap 102 is drawn from the track, the spring-loaded straight track covers 760 and spring-loaded corner track covers 761 are forced open by the striping action of the strap 102. The tensioning process continues until a desired amount of the strap 102 (e.g., all of the strap) is drawn from the track assembly 700 and tightened around the bundle. Thus, the track assembly 700 does not require complex hydraulic or pneumatic actuation systems to open the track sections and release the strap during tensioning. This arrangement reduces the cost of the track sections, simplifies maintenance of the track, and reduces the likelihood of the strap 102 being jammed or snagged during the strap release process.

Figure 28:
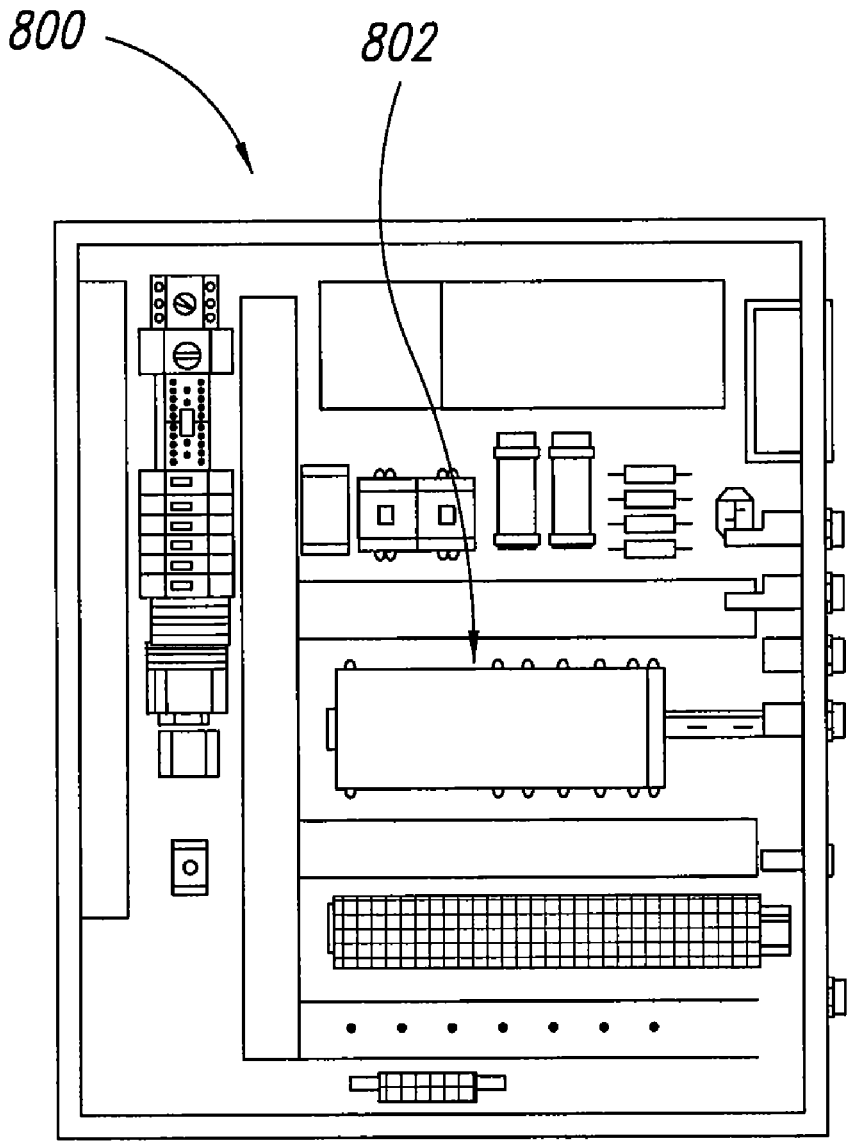
FIG. 28 is a front elevational view of a control system in accordance with one embodiment.
Figure 29:
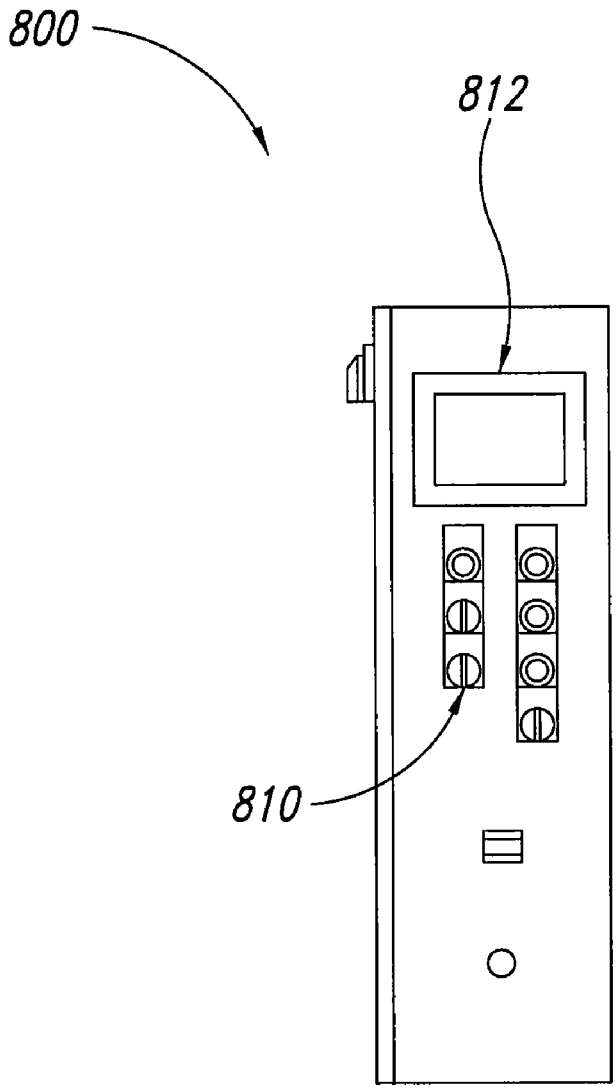
FIG. 29 is a side view of operator controls of the control system of FIG. 28.

Control System:

The strapping apparatus 100 is controlled by a control system 800 illustrated in FIG. 28 that may include a programmable logic controller (PLC) 802 which operates in conjunction with various input and output devices and controls the major subassemblies of the strapping apparatus 100. Input devices may include, for example, momentary and maintained push buttons, selector switches, toggle switches, limit switches, photoelectric sensors, and inductive proximity sensors. Output devices may include, for example, solid state and general purpose relays, solenoids, and indicator lights. Input devices are scanned by the controller 802, and their on/off states are updated in a controller program. The controller 802 executes the controller program and updates the status of the output devices accordingly. Other control functions of the controller 802 are described below in further detail.

In some embodiments, the programmable controller 802 and its associated input and output devices may be powered using a 24 VDC power supply. The controller 802, power supply, relays, and fuses may be contained within a control panel, as illustrated in FIG. 28. The momentary and maintained push buttons, selector switches, and toggle switches 810 may be located on the control panel. The limit switches, inductive proximity sensors, photoelectric sensors, and solenoids are typically located within the strapping apparatus 100 at their point of use. An indicator light stack 811 (FIG. 25) may be mounted on the top of the arch indicating a strap mis-feed, out-of-strap, normal running or machine malfunction condition, for example.

One commercially-available PLC 802 suitable for use with the strapping apparatus 100 is the MICROLOGIX 1500 manufactured by Allen-Bradley/Rockwell. This device includes PNP digital and relay type outputs. In addition the PLC utilizes input and output cards to interface to external production line equipment control system and to four machine mounted motors (e.g., Dunkermotoren BG75 servomotors) which drive the accumulator 300 (FIG. 4), feed and primary tension 430 (FIG. 16), secondary tension 431 (FIG. 16) and sealing head functions 540 (FIG. 20). One skilled in the art will understand that another industry standard PLC may also be used in place of the PLC described above.

The MICROLOGIX 1500 PLC 802 has communication ports, including an RS232C port for program uploads, downloads and monitoring and a RS232C port for connection to an EZ-AUTOMATION HMI (Human-Machine-Interface) 812 mounted to the control panel side. The HMI provides machine diagnostics and operational data (e.g., number of straps applied, sensor status, etc.) in addition to providing operational parameter selections (e.g., strap position on the bundle, number of straps per bundle, etc.) The controller software used to program the controller 802 may, for example, include Allen-Bradley/Rockwell programming software available from the Allen-Bradley/Rockwell Company.

Strapping Machine Operation:

In brief, the operation of the strapping apparatus 100 involves paying off strap 102 from a strap coil 214 located on the dispenser 200 and feeding a free end of the strap 102 through the accumulator 300, through the feed and tension unit 400, up through the sealing head assembly 500, and then around the track assembly 700. After the strap 102 is fed around the track assembly 700, the free end is guided back into the sealing head assembly 500. At this point, the strap 102 is in position to start a strapping cycle where the strap 102 can be tensioned and secured about a bundle of objects.

The strapping apparatus 100 can be operated in either a manual strapping mode or an automatic strapping mode. The strapping apparatus 100 typically operates in an automatic production line in the automatic strapping mode. If the operator has to intervene or the apparatus 100 needs to be repaired off line, the machine can be operated in the manual strapping mode. The manual mode can be used to apply single or multiple straps about a bundle of objects while an operator actuates a switch. Likewise, the automatic mode is primarily used to apply a single strap to a bundle of objects when a switch, for example an optically or mechanically operated proximity switch, senses a moving bundle within the strapping station 120. The automatic mode can be used in conveyor lines and in conjunction with other automated machinery. An option to apply multiple straps to a bundle of objects, when in automatic mode, is also available on the HMI 812.

Strap Feeding Operation:

Before a feeding operation can be commenced, the accumulator 300 needs to be filled. Filling the accumulator 300 first substantially reduces the need to quickly accelerate the coil during the feeding sequence. To initially feed strap 102 into the strapping apparatus 100, a free end of strap is removed from the strap coil 214, guided into the accumulator guide 318. The presence of the strap 102 may cause the strap exhaust switch 222 of FIG. 3 to be toggled, thus sending a signal to the controller 802 that a continuous line of strap 102 exists between the dispenser 200 and the accumulator 300. The strap 102 is guided between the accumulator drive wheel 312 and the accumulator pinch wheel 314, triggering the accumulator feed switch 316. The accumulator drive and pinch wheels 312 and 314, respectively, are then employed to push strap over the closed strap diverter 322, through the vertical guide 332, and into the feed and tension unit 400 where the strap 102 is engaged by the feed and primary tension rollers 402, 404. From this point, the strap 102 is fed by the feed and primary tension rollers 402, 404 to the feed/tension detect sensor 435. At this point, the feed sequence can stop, and the strap diverter actuator 320 moves the strap diverter 322 to the open position such that strap begins to fill the accumulator 300.

As the accumulator chamber 306 fills with strap, one or both sensors 388, 389 can monitor the loop in the accumulator container 303 and transmit one or more signals to the controller 802 when the accumulator chamber 306 has been partially or completely filled. In response to the signal(s), the controller 802, after a short time delay, de-energizes the driver 310 and activates the dispenser brake 210 to halt the accumulator filling sequence. A time delay may occur between when the dispenser brake 210 is activated and when the driver 310 is de-energized in order for a substantial portion of slack to be taken from the dispenser strap coil 214. This time delay keeps the strap 102 adequately taut between the dispenser 200 and the accumulator 300 so that any exposed strap does not become twisted or kinked.

In continuing to follow the free end of the strap 102 through the initial feeding process, the strap free end is guided from the accumulator 300 into the vertical guide 332 leading to the feed and tension unit 400. The first set of wheels to pinch the strap 102 is the feed and primary tension drive wheel 402 and the spring loaded feed and primary tension pinch wheel 404.

The feed and primary tension drive and pinch wheels, 402, 404 feed the strap through the sealing head assembly 500, around the track assembly 700, and back into the sealing head assembly 500. When the free end of the strap 102 has been guided around the track and reaches the sealing head assembly 500, the arrival of the free strap end is detected by a feed stop switch (not shown) located with the sealing head assembly 500, which transmits a feed stop signal to the controller 802. The controller 802 then sends a signal to the feed and primary tension servomotor 430 to stop the feed and primary tension drive wheel 402 thereby stopping the strap 102, and completing the feeding sequence.

Tensioning/Bundling Operation:

During a tensioning or bundling operation, the tensioning of the strap occurs in two stages, a primary tension stage and a secondary tension stage. In the primary tensioning stage, the strap 102 is pinched between the feed and primary tension drive wheel 402 and the feed and primary tension pinch wheel 404. Referring back to FIG. 16, an extension spring 434 engages the feed and primary tension pinch wheel 404 against the feed and primary tension drive wheel 402. As the strap 102 is pulled tightly around the bundle during the primary tensioning sequence, the feed and primary tension pinch wheel 404 stops rotating due to the slippage of the strap 102 on the feed and primary tension drive wheel 402. The slippage of the strap 102 coincides with the secondary tensioning stage and is discussed in more detail below.

The feed and tension unit 400 can include a proximity sensor located adjacent to the feed and primary tension pinch wheel 404. The proximity sensor is operatively coupled to the controller 802. The proximity sensor monitors the feed and primary tension pinch wheel 404 during primary tensioning, such as by monitoring the passing of a lobe on the wheel 404 in order to detect the stall of the feed and primary tension pinch wheel 404. The proximity sensor transmits signals to the controller 802. If the signals from the proximity sensor indicate that the primary tension pinch wheel 404 is not turning due to the slippage of the strap 102 on the feed and primary tension drive wheel 402, then the controller 802 initiates the secondary tensioning sequence.

The secondary tensioning sequence involves the strap being pinched between the secondary tension pinch wheel 412 and the secondary tension drive wheel 410. Referring to FIG. 16, a secondary tension pinch solenoid 470 may be used to hold the strap against the secondary tension drive wheel 410. Then, the secondary tension drive wheel 410 is driven by the secondary tension servomotor 431 located in the feed and tension assembly 400. The secondary tension sequence continues until the secondary tension drive wheel servomotor 431 stalls at the preset torque setting. The secondary tension servomotor 431 operates in the torque mode supplying an adjustable amount of torque. This torque is typically set for the given application and not changed; however, it may be adjusted as required with the potentiometer located inside the control cabinet. The secondary tensioning operation binds the strap 102 tightly around the bundle of objects located in the strapping station 120. After the strap 102 is tensioned to the point that the servomotor 431 stalls, the controller 802 permits a predetermined amount of time to pass to allow the sealing head to rotate and the cutter/gripper 508 to grip the strap. After both grippers 504, 508 have secured the strap, the tension is released just prior to cutting the strap from the supply to prevent the strap 102 from fraying. The strap is then cut and sealed. Once the sealing operation is complete, the feeding sequence may then be repeated.

The primary tensioning sequence discussed above provides enough force on the strap 102 to pull the strap 102 from the track guide 716 (FIG. 26). The track assembly 700 is configured to permit the strap 102 to smoothly and uniformly be removed from the track guide 716. As the strap 102 is tensioned around the bundle of objects, the straight and corner track covers 760 and 761 (FIG. 27) can be opened by the strap 102, allowing the strap 102 to pull clear of the guide passage 716.

After the strap 102 clears the guide passage 716 and the strap is pulled down around a bundle of objects thus causing both the straight and corner track covers, 760 and 761, respectively, to be closed by the springs 732. At this point, the track 700 is ready for the strap 102 to be fed again after the bundling operation has been completed.

Strap Sealing Operation:

Once the strap 102 has been sufficiently tensioned around the bundle of objects, the non-free end of the strap can be cut and then both ends of the strap 102 can be sealed together. The sealing operation commences when several sealing head cams 502 in the sealing head assembly 500 begin to rotate, forcing the gripper 504 to pinch the free end of the strap 102 against the anvil 506. Those skilled in the art will recognize that the strapping apparatus 100 can be configured, depending on strap orientation, to accommodate the same gripper on the opposite side. After gripping the free end of the strap 102 in the sealing head assembly 500, the feed and tension unit 400 retracts the excess strap 102 from the track assembly 700 (i.e., the tensioning operation discussed above).

The cams 502 can operate as polynomial cams allowing the sealing head assembly 500 to operate smoothly at increased speeds. In addition, the cam follower pressure angles can be minimized to extend the life of the cams.

With the free end of the strap 102 being gripped by the gripper 504 and the non-free end of the strap 102 being gripped by the cutter/gripper 508, the tension applied, by the servomotor driven secondary tension wheel 410, on the strap can be released. A cutter 514 is then maneuvered toward the non-free end of the strap 102 to cut the strap, thus creating a second free end of the strap 102. The strap 102 which remains securely taut around the bundle of objects, now has two free ends configured in an overlapping orientation.

In one embodiment, the strap 102 used to bundle objects can have a heat-activated adhesive applied thereon. Preferably, the adhesive on the strap 102 is applied to the strap 102 during the manufacturing process of the strap. Heat is applied to the strap by inserting the heater blade 510 between the two overlapping ends of the strap and lightly pressing the ends against the blade 510 by raising the press platen 512. The press platen 512 is then lowered slightly to allow the heater blade 510 to be removed from between the strap ends. Next, the press platen 512 is raised again to press both ends of the strap against the anvil 506 for bonding and cooling the adhesive. As the sealing head cams 502 continue to rotate, the press platen 512 lowers slightly once more allowing the anvil 506 to open and release the now sealed strap ends. After the strap is released, the anvil 506 is closed and the strapping cycle is completed.

The following discussion of the operation of the servomotor 540 driven sealing head will assist those skilled in the art to better understand the cam sequence discussed above and also provide more detail on the sealing operation. In short, the servomotor 540 drive controls the rotation of the cams 502, which in turn control the movements of the anvil 506, heater blade 510, and press platen 512, among others. As seen in FIG. 20, the sealing head servomotor 540 drives the sealing head assembly components 500 by means of an inline coupling connecting the servomotor 540 to the sealing head mainshaft 518. Now referring back to FIG. 20, the rotation of the sealing head assembly main shaft 518 causes the keyed cams 502 to rotate and perform the necessary gripping, sealing, and cutting functions. During a first period of rotation, the main shaft 518 rotates to the first of three stops in the servomotor 540 routine, causing a cutter-gripper assembly 508 to grip the strap 102 and the inner slide 520 to move out of the strap path. The servomotor 431 driven secondary tension wheel 410 then tensions the strap about the bundle as previously discussed. When the strap tensioning is complete, the controller 802 signals the sealing head servomotor 540 to rotate allowing the cams 502 to rotate into a second period of rotation.

During the second period of rotation, which commences the dry sealing process, the cutter/gripper 508 grips the strap just ahead of the feed stop switch. Once the strap is firmly gripped, the tension in the strap, upstream of the track assembly 700, is released. The sealing head continues to rotate allowing the press platen 512 and the cutter 514 rise to cut the strap 102 and press the strap against the heater blade 510. The cams 502 continue to rotate through a dwell section as the adhesive on the strap is melted by the heater blade 510. After a predetermined time for melting has passed, the press platen 512 and the cutter 514 retract slightly, allowing the heater blade 510 to retract. The accurate and sequential timing of the dry sealing operation is important in achieving a sufficient amount of heat to properly secure the straps without imparting too much heat and causing the strap bond to be weakened. The dry sealing operation, accurately timed through the use of a servomotor 540 drive and keyed cams, has the advantage of not using water on the water soluble straps, such that the amount of heat applied can be accurately controlled to repeatedly produce strong, reliable bundled objects.

After the heater blade 510 retracts, the press platen 512 rises again to press the melted adhesive on the two strap ends together for cooling and sealing. The sealing head main shaft 518 continues to rotate during a third period of rotation until the servomotor 540 stops the sealing head. The sealing head assembly 500 remains in this position for a predetermined time until the controller 802 again signals the servomotor 540 to execute the next routine. The continued rotation of the cams 502 release the press platen 512 the gripper and cutter/gripper 504 and 508, to travel back to their home positions. One of the cams 502 then pivots the anvil 506 out of the strap line past a pair of strippers 530. As the anvil 506 pivots, the strippers 530 push the strap off of the anvil 506. After the strap 102 is out of the sealing head assembly 500, the anvil 506 closes, and the cams 502 reach their home positions. With the cams 502 at their home positions the servomotor 540 reaches the third and final stop as the home position switch 516 (FIG. 20) signals the controller 802 to begin another feed sequence.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

Strap Replacement Operation:

When the strap coil 214 is depleted, the strap exhaust switch 222 is no longer actuated which stops the strapping apparatus 100 until the strap coil 214 is replenished. When the strap exhaust switch 222 is no longer actuated, the control system 802 signals the accumulator servomotor 310 to stop, thus preventing the free end of the strap 102 from being drawn into the accumulator 300. The accumulator 300 can continue to run using the stored strap therein until there is an insufficient amount of strap for a complete feed sequence. The remaining loose tail of strap can then be automatically ejected from the accumulator 300, by the accumulator driver 310, before a new strap coil 214 is installed. The empty strap coil 214 can be replaced by removing the outer hub 208 and then removing the strap coil 214. Next, a fresh strap coil 214 can be installed with the strap 102 wound in a clockwise direction. Finally, a nut securing the outer hub 208 can be securely re-tightened.

Except as described herein, the embodiments, features, systems, devices, materials, methods and techniques described herein may, in some embodiments, be similar to any one or more of the embodiments, features, systems, devices, materials, straps, methods and techniques described in U.S. Patent Publication No. 2004/0200191 and U.S. Provisional Patent Application No. 60/903,230. In addition, the embodiments, features, systems, devices, materials, methods and techniques described herein may, in certain embodiments, be applied to or used in connection with any one or more of the embodiments, features, systems, devices, materials, methods and techniques disclosed in the above-mentioned U.S. Patent Publication No. 2004/0200191 and U.S. Provisional Patent Application No. 60/903,230. U.S. Patent Publication No. 2004/0200191 and U.S. Provisional Patent Application No. 60/903,230 are hereby incorporated by reference herein in their entireties.

Although specific embodiments of, and examples for, the invention are described herein for illustrative purposes, various equivalent modifications are possible within the scope of the invention, as those skilled in the relevant art will recognize. The teachings provided herein of the invention can be applied to other methods and apparatus for strapping bundles of objects, and not just to the methods and apparatus for strapping bundles of objects described above and shown in the figures. In general, in the following claims, the terms used should not be construed to limit the invention to the specific embodiments disclosed in the specification. Accordingly, the invention is not limited by the foregoing disclosure, but instead its scope is to be determined by the following claims.

What is claimed is:

1. A strapping apparatus for bundling objects, comprising:

a track assembly extending about a strapping station, the track assembly adapted to receive a strap and to bundle objects using the strap; and an accumulator for accumulating the strap used by the track assembly, the accumulator comprising:

a strap conveyor system including a strap feeding unit and a strap receiving unit spaced apart from the strap feeding unit such that a strap path of travel extends between the strap feeding unit and the strap receiving unit;

an accumulator container defining a chamber and including a strap diverter, a first sidewall, and an entrance, the entrance extending longitudinally along the strap path of travel, the entrance having a longitudinal length and a width that is less than the longitudinal length, the strap diverter being movable away from the first sidewall from a closed position to an open position to increase the width along substantially all of the longitudinal length of the entrance to open the entrance, such that a strap extends along the strap path of travel and is supported by or positioned over an engagement portion of the strap diverter in the closed position and the strap is unconstrained and free to move downwardly through the entrance defined by the engagement portion and the first sidewall and past the engagement portion of the strap diverter when the strap diverter is in the open position.

2. The strapping apparatus of claim 1, wherein the strap diverter includes a panel movably coupled to a second sidewall of the accumulator container, the panel pivots relative to the second sidewall about an axis of rotation that is substantially parallel to the strap path of travel.

3. The strapping apparatus of claim 2, wherein the panel has an upper edge of the engagement portion adapted to support the strap, the upper edge extends along substantially the entire strap path of travel when the strap diverter is in the closed position and the upper edge is spaced laterally away from the strap path of travel when the strap diverter is in the open position.

4. The strapping apparatus of claim 1, wherein the strap diverter is rotatable about an axis of rotation such that the strap diverter in the open position rotates away from the strap path of travel to an off-line position to expose a user access opening in the accumulator container, the open position is between the closed position and the off-line position.

5. The strapping apparatus of claim 1, wherein the accumulator further comprises a strap diverter actuator that moves the strap diverter between the open position and the closed position when the strap diverter actuator is energized.

6. The strapping apparatus of claim 5, wherein the strap diverter actuator comprises a solenoid.

7. The strapping apparatus of claim 1, wherein the strap feeding unit and the strap receiving unit are spaced apart from each other a sufficient distance such that a portion of a strap extending between the strap feeding unit and the strap receiving unit hangs through the entrance into the chamber due to gravity when the strap diverter is in the open position.

8. The strapping apparatus of claim 1, wherein the accumulator container includes a second sidewall spaced apart from the first sidewall, the first sidewall and the second sidewall substantially enclose the chamber, the first sidewall includes the strap diverter, a panel, and a coupler pivotally coupling the strap diverter to the panel.

9. The strapping apparatus of claim 1, wherein the accumulator further includes at least one sensor adapted to detect whether at least a portion of a strap is in the chamber.

10. The strapping apparatus of claim 1, wherein the engagement portion moves away from an imaginary vertical plane in which the strap path of travel lies when the strap diverter moves from the closed position to the open position.

11. The strapping apparatus of claim 1, wherein substantially all of the engagement portion is spaced apart from the strap as the strap passes through the entrance into the chamber due to gravity.

12. The strapping apparatus of claim 1, wherein the strap diverter comprises a member pivotable about an axis of rotation, the axis of rotation and the strap path of travel lie along an imaginary plane, and the engagement portion moves away from or towards the imaginary plane as the strap diverter moves between the closed position and the open position.

13. A strapping apparatus for bundling objects, comprising:

a track assembly for receiving a strap and bundling objects using the strap;

an accumulator for accumulating the strap used by the track assembly, the accumulator comprising:

a strap conveyor system including a strap feeding unit, a strap receiving unit, and a strap path of travel extending between the strap feeding unit and the strap receiving unit;

an accumulator container defining a chamber for receiving the strap, the accumulator container including:

a sidewall defining a portion of the chamber, a strap diverter movable between a closed position and an open position, the strap diverter including an engagement portion that is positioned underneath the strap path of travel when the strap diverter is in the closed position, and an entrance between the strap diverter and the sidewall, the entrance having a longitudinal axis that is substantially parallel to the strap path of travel and a width taken perpendicularly to the longitudinal axis, the width along most of a longitudinal length of the entrance is increased and substantially the entire engagement portion is move out from underneath the strap as the strap diverter is moved from the closed position to the open position.

14. The strapping apparatus of claim 13, wherein the engagement portion of the strap diverter moves away from an imaginary vertical plane in which the strap path of travel lies when the strap diverter moves from the closed position to the open position.

15. The strapping apparatus of claim 13, wherein the engagement portion is located outside of the chamber when the strap diverter is in the open position and when the strap diverter is in the closed position.

16. The strapping apparatus of claim 13, wherein the engagement portion is pivotable about an axis of rotation, the axis of rotation and the strap path of travel lie along an imaginary plane, and the engagement portion is pivotable away from the imaginary plane.

17. The strapping apparatus of claim 13, wherein the engagement portion extends along substantially the entire length of the strap path of travel located between the strap feeding unit and the strap receiving unit when the strap diverter is in the closed position.

18. The strapping apparatus of claim 13, wherein the engagement portion is spaced horizontally away from an imaginary vertical plane in which the strap path of travel lies when the strap diverter is in the open position such that gravity causes the strap to extend vertically downward past the engagement portion.

19. A strapping apparatus for bundling objects, comprising:

a track assembly for receiving a strap and bundling objects using the strap; and an accumulator for accumulating the strap used by the track assembly, the accumulator comprising:

a strap conveyor system defining a strap path of travel that lies in an imaginary vertical plane, and an accumulator container including an entrance and a strap diverter being movable between a closed position and an open position, the strap diverter including an engagement portion that is positionable to support or be located under the strap path of travel when the strap diverter is in the closed position, and the engagement portion moves out from under the strap path of travel and away from the imaginary vertical plane when the strap diverter moves from the closed position to the open position.

20. The strapping apparatus for bundling objects of claim 19, wherein the engagement portion is spaced apart from the imaginary vertical plane when the strap diverter is in the open position and extends through the imaginary vertical plane when the strap diverter is in the closed position.

21. The strapping apparatus for bundling objects of claim 19, wherein the strap diverter includes a panel that rotates about a substantially horizontal axis of rotation, the panel defines one side of a strap holding chamber of the accumulator.

22. The strapping apparatus for bundling objects of claim 19, wherein the strap diverter is movable between the closed position and the open position without any portion of the strap diverter passing through the entrance of the accumulator container.

* * * * *